US010482899B2

(12) United States Patent
Ramprashad et al.

(10) Patent No.: US 10,482,899 B2
(45) Date of Patent: Nov. 19, 2019

(54) COORDINATION OF BEAMFORMERS FOR NOISE ESTIMATION AND NOISE SUPPRESSION

(71) Applicant: Apple Inc., Cupertino, CA (US)

(72) Inventors: Sean A. Ramprashad, Los Altos, CA (US); Esge B. Andersen, Campbell, CA (US); Joshua D. Atkins, Los Angeles, CA (US); Sorin V. Dusan, San Jose, CA (US); Vasu Iyengar, Pleasanton, CA (US); Tarun Pruthi, Fremont, CA (US); Lalin S. Theverapperuma, Cupertino, CA (US)

(73) Assignee: Apple Inc., Cupertino, CA (US)

( * ) Notice: Subject to any disclaimer, the term of this patent is extended or adjusted under 35 U.S.C. 154(b) by 272 days.

(21) Appl. No.: 15/225,707

(22) Filed: Aug. 1, 2016

(65) Prior Publication Data

US 2018/0033447 A1 Feb. 1, 2018

(51) Int. Cl.

| | |
|---|---|
| ***G10L 21/028*** | (2013.01) |
| ***G10L 25/21*** | (2013.01) |
| ***G10L 21/0216*** | (2013.01) |

(52) U.S. Cl.

CPC ..... *G10L 21/028* (2013.01); *G10L 21/0216* (2013.01); *G10L 25/21* (2013.01); *G10L 2021/02165* (2013.01); *G10L 2021/02166* (2013.01)

(58) Field of Classification Search

CPC ..... H04R 1/08; H04R 1/09; G10L 25/90
USPC ..... 704/226; 381/71.4, 86
See application file for complete search history.

(56) References Cited

U.S. PATENT DOCUMENTS

| | | | |
|---|---|---|---|
| 6,898,566 | B1 | 5/2005 | Benyassine et al. |
| 6,963,649 | B2 | 11/2005 | Vaudrey et al. |
| 7,274,794 | B1 | 9/2007 | Rasmussen |
| 7,536,301 | B2 | 5/2009 | Jaklitsch et al. |
| 7,761,106 | B2 | 7/2010 | Konchitsky |
| 8,019,091 | B2 | 9/2011 | Burnett et al. |
| 8,046,219 | B2 | 10/2011 | Zurek et al. |
| 8,068,619 | B2 | 11/2011 | Zhang et al. |
| 8,194,882 | B2 | 6/2012 | Every et al. |

(Continued)

OTHER PUBLICATIONS

Nearfield broadband frequency invariant beamforming; Acoustics, Speech, and Signal Processing, 1996. ICASSP-96. Conference Proceedings., 1996 IEEE International Conference on (vol. 2 ) May 1996; pp. 905-908.

(Continued)

*Primary Examiner* — Akwasi M Sarpong
(74) *Attorney, Agent, or Firm* — Womble Bond Dickinson (US) LLP

(57) ABSTRACT

An audio system has a housing in which are integrated a number of microphones. A programmed processor accesses the microphone signals and produces a number of acoustic pick up beams based groups of microphones, an estimation of voice activity and an estimation of noise characteristics on each beam. Two or more beams including a voice beam that is used to pick up a desired voice and a noise beam that is used to provide information to estimate ambient noise are adaptively selected from among the plurality of beams, based on thresholds for voice separation and thresholds for noise-matching. Other embodiments are also described and claimed.

29 Claims, 11 Drawing Sheets

(56) References Cited

U.S. PATENT DOCUMENTS

| | | | | |
|---|---|---|---|---|
| 8,204,252 | B1 | 6/2012 | Avendano | |
| 8,204,253 | B1 | 6/2012 | Solbach | |
| 8,275,609 | B2 | 9/2012 | Wang | |
| 8,374,362 | B2 | 2/2013 | Ramakrishnan et al. | |
| 8,401,178 | B2 | 3/2013 | Chen et al. | |
| 8,521,530 | B1 | 8/2013 | Every et al. | |
| 9,100,756 | B2 | 8/2015 | Dusan et al. | |
| 9,215,527 | B1 | 12/2015 | Saric et al. | |
| 2002/0193130 | A1 | 12/2002 | Yang et al. | |
| 2004/0181397 | A1 | 9/2004 | Gao | |
| 2007/0230712 | A1 | 10/2007 | Belt et al. | |
| 2007/0237339 | A1 | 10/2007 | Konchitsky | |
| 2007/0263845 | A1 | 11/2007 | Hodges et al. | |
| 2007/0263936 | A1* | 11/2007 | Owechko | G06K 9/00369 382/224 |
| 2007/0274552 | A1 | 11/2007 | Konchitsky et al. | |
| 2008/0201138 | A1 | 8/2008 | Visser et al. | |
| 2008/0317259 | A1 | 12/2008 | Zhang et al. | |
| 2009/0190769 | A1 | 7/2009 | Wang et al. | |
| 2009/0196429 | A1 | 8/2009 | Ramakrishnan et al. | |
| 2009/0220107 | A1 | 9/2009 | Every et al. | |
| 2010/0081487 | A1 | 4/2010 | Chen et al. | |
| 2010/0091525 | A1 | 4/2010 | Lalithambika et al. | |
| 2010/0098266 | A1 | 4/2010 | Mukund et al. | |
| 2010/0100374 | A1 | 4/2010 | Park et al. | |
| 2011/0106533 | A1 | 5/2011 | Yu | |
| 2011/0317848 | A1 | 12/2011 | Ivanov et al. | |
| 2012/0121100 | A1 | 5/2012 | Zhang et al. | |
| 2012/0130713 | A1 | 5/2012 | Shin et al. | |
| 2012/0185246 | A1 | 7/2012 | Zhang et al. | |
| 2012/0209601 | A1 | 8/2012 | Jing | |
| 2012/0310640 | A1 | 12/2012 | Kwatra et al. | |
| 2013/0054231 | A1 | 2/2013 | Jeub | |
| 2013/0216050 | A1 | 8/2013 | Chen et al. | |
| 2013/0282372 | A1 | 10/2013 | Visser et al. | |
| 2013/0329895 | A1 | 12/2013 | Dusan et al. | |
| 2013/0329896 | A1* | 12/2013 | Krishnaswamy | H04R 29/005 381/58 |
| 2013/0329909 | A1* | 12/2013 | Krishnaswamy | H04R 3/002 381/94.2 |
| 2013/0332157 | A1* | 12/2013 | Iyengar | G10L 15/20 704/233 |
| 2014/0126745 | A1* | 5/2014 | Dickins | H04R 3/002 381/94.3 |
| 2014/0286497 | A1 | 9/2014 | Thyssen et al. | |
| 2015/0110284 | A1 | 4/2015 | Niemisto et al. | |
| 2015/0221322 | A1* | 8/2015 | Iyengar | G10L 25/84 704/226 |
| 2015/0379992 | A1* | 12/2015 | Lee | G10L 15/22 704/275 |
| 2016/0029111 | A1* | 1/2016 | Wacquant | H04R 3/005 381/71.4 |
| 2016/0127535 | A1* | 5/2016 | Theverapperuma | H04M 3/002 455/570 |
| 2016/0358619 | A1* | 12/2016 | Ramprashad | G10L 15/34 |
| 2017/0337932 | A1 | 11/2017 | Iyengar et al. | |

OTHER PUBLICATIONS

Near-field beamforming for microphone arrays; Acoustics, Speech, and Signal Processing, 1997. ICASSP-97., 1997 IEEE International Conference on (vol. 1 ) Apr. 1997; pp. 363-366.

U.S. Notice of Allowance, dated Sep. 29, 2016, U.S. Appl. No. 14/170,136.

Final Office Action, dated Oct. 20, 2016, U.S. Appl. No. 13/911,915.

Non-Final Office Action (dated Jul. 31, 2014), U.S. Appl. No. 13/911,915, filed Jun. 6, 2014, First Named Inventor: Vasu Iyengar, 19 pages.

Non-Final Office Action (dated Jan. 30, 2015), U.S. Appl. No. 13/715,422, filed Dec. 14, 2012, First Named Inventor: Sorin V. Dusan, 16 pages.

Final Office Action (dated Apr. 21, 2015), U.S. Appl. No. 13/911,915, filed Jun. 6, 2014, First Named Inventor: Vasu Iyengar, 21 pages.

Non-Final Office Action (dated Mar. 18, 2016), U.S. Appl. No. 13/911,915, filed Jun. 6, 2013, First Named Inventor: Vasu Iyengar, 20.

Final Office Action (dated Apr. 27, 2016) U.S. Appl. No. 14/170,136, filed Jan. 31, 2014, First Named Inventor: Vasu Iyengar, 14.

"Sound Basics", *Acoustic and vibrations*, Internet document at: http://www.acousticvibration.com/sound-basis.htm, 3 pages.

Jeub, Marco , et al., "Noise Reduction for Dual-Microphone Mobile Phones Exploiting Power Level Differences", *Acoustics, Speech and Signal Processing (ICASSP), 2012 IEEE International Conference*, Mar. 25-30, 2012, ISSN: 1520-6149, E-ISBN: 978-1-4673-0044-5, pp. 1693-1696.

Khoa, Pham C., "Noise Robust Voice Activity Detection", *Nanyanq Technological University, School of Computer Engineering*, a thesis, 2012, Title page, pp. i-ix, and pp. 1-26.

Nemer, Elias , "Acoustic Noise Reduction for Mobile Telephony", *Nortel Networks*, 17 pages.

Schwander, Teresa , et al., "Effect of Two-Microphone Noise Reduction on Speech Recognition by Normal-Hearing Listeners", *Journal of Rehabilitation Research and Development*, vol. 24, No. 4, Fall 1987, pp. 87-92.

Tashev, Ivan , et al., "Microphone Array for Headset with Spatial Noise Suppressor", *Microsoft Research, One Microsoft Way, Redmond, WA, USA, In Proceedings of Ninth International Workshop on Acoustics, Echo and Noise Control*, Sep. 2005, 4 pages.

Verteletskaya, Ekaterina , et al., "Noise Reduction Based on Modified Spectral Subtraction Method", *IAENG International Journal of Computer Science*, 38:1, IJCS 38 1 10, (Advanced online publication: Feb. 10, 2011), 7 pages.

Widrow, Bernard , et al., "Adaptive Noise Cancelling: Principles and Applications", *Proceedings of the IEEE*, vol. 63, No. 12, Dec. 1975, ISSN: 0018-9219, pp. 1692-1716 and 1 additional page.

* cited by examiner

COORDINATION OF BEAMFORMERS FOR NOISE ESTIMATION AND NOISE SUPPRESSION

FIELD

One aspect of the disclosure herein relates to digital signal processing techniques for reducing audible noise from an audio signal that contains voice or speech that is being picked up by a mobile phone.

BACKGROUND

Mobile phones can be used in acoustically different ambient environments, where the user's voice (speech) that is picked up during a phone call or during a recording session is usually mixed with a variety of types and levels of other undesirable sounds (including ambient sounds and the voice of another talker.) These undesirable sounds (also referred to as noise) are often picked up on the microphone(s) and thus often degrade the acquisition of the desired speech. For example, pickup of such undesirable sounds can reduce speech intelligibility of the user's speech as heard at the far-end of a phone call. Pickup of such undesirable sounds can also lead to significant voice distortion particularly after having been processed by voice coders in a cellular communication network. For at least these reasons, it is typically desirable to apply a high quality, digital noise suppression process to the mixture of speech and noise of the acquired audio signal, before passing the signal to next steps in its transmission to the far-end, e.g. passing the signal to a cell voice coder in a baseband communications chip of the mobile phone.

In the handset mode of operation (against the ear) in some current mobile phones, audio signals from more than one microphone can be used together in a multiple (e.g. two)-microphone noise suppression process. The general approach relies on the fact that some microphones, or combination of some microphones, can be used more effectively than others to estimate either the desired speech or the unwanted noise components. Such estimates help in the noise suppression process. In some cell-phones the microphones or combination of microphones is clear, e.g. microphones closer to the user's mouth would have a higher signal to noise ratio (SNR) than those further away, the signal being the desired speech. SNRs can also be tested or computed, a-priori, during the design process. This could be done by either measuring with known noise or estimating with unknown noise a stationary noise spectrum for the microphone signal and then further estimating spectrums of the desired speech when such speech is active. The ratio of two spectrums is used to estimate the SNR. The microphone signal having the largest SNR is then selected to be the voice dominant input of the two microphone NS process. Conversely, the microphone having the lower SNR can be used to better estimate or predict the noise spectrum, both stationary and dynamic.

SUMMARY

The inventors herein have recognized that, while effective, a two-microphone noise suppression process has some limits as it is sometimes not able to accurately estimate either the desired speech (voice) spectrum or the noise spectrum. For example, sometimes the two-microphone noise suppression process does not work well in the presence of transient background noise (including a competing talker). In addition, the desired speech component and noise component can often be present in an acquired audio signal at high levels on both microphones. Thus an a-priori determination or selection of mics for noise estimation and those for voice estimation may not hold in all circumstances. Noise estimation, which is a computation or estimate of the noise component by itself, plays a key role when trying to remove noise components from a microphone signal without distorting the speech components therein. For greater accuracy, a multi-microphone noise estimation process needs i) increased "voice separation", where voice separation refers to the sound pressure differences of the desired speech as seen on one set of microphones compared to another group of microphones, and ii) improved "noise matching", where noise matching refers to how well the noise picked up on one group of microphones matches that on another group of microphones. Increased voice separation improves the ability of the audio system to estimate the desired speech spectrum and speech activity. Better noise matching improves the ability of one group of microphones, often those with lower SNR, to be used to predict the noise on another group of microphones.

Practically, voice-separation can be defined, as a measure of the difference between the energy or power spectrums of the desired speech component as seen on two audio channels, an audio channel being an individual microphone or a linear combinations of microphones, that are active during a phone call or during a recording session. If the noise components on the two channels are approximately the same (there is good noise matching) the voice separation value itself can be viewed as the difference between the energy or power spectrums, or even the SNRs, of the two channels. Thus, when desired speech is active it is expected that there is to be an energy or power spectrum difference between the two channels in line with the SNR difference. The parameters of a Voice Activity Detector (VAD) or of a noise estimator, where the latter could be part of a noise suppressor, can therefore be adjusted, based on the voice separation value. Determinations of voice activity can be made in different frequency sub-bands which typically helps to improve both the noise estimation process and speech estimation process. Generally, as the voice separation value increases, accuracy of VAD decisions and signal estimations may be improved. Increased voice separation also helps differentiate desired speech from other signals, like transient noise, which may show similar properties to speech.

Noise-matching, considers the characteristics of noises captured by the two audio pickup channels, an audio channel being an individual microphone or a linear combinations of microphones, that are active during a phone call or during a recording session. For a pair of ideal omni-directional microphones, noises that are either diffuse or emanating from a very far distance (noises in the far field of the microphones) often will show a very similar sound pressure pattern on the two microphones. Though there may be differences in the time of arrival of signals due to microphones being separated in space, for two closely spaced microphones the general power spectrums of audio signals received by the two microphones can be very similar. Practically, when microphones are mounted on a device, covered with meshes, and are placed against surfaces, the signals seen on the two microphones can contain some spectral differences. In this case, even with diffuse or far-field sources, the signals produced by the microphones are different and the spectral shapes of the responses, and thus the noise, do not "match". In some cases, a correction factor may be determined and applied to compensate for any gross frequency variation between responses of the various microphones or combination of microphones, such that the spectral shapes of the responses "match". This enables the system to use one set of microphones to better predict the noise on another set of microphones. When noise matching is achieved between signals, it also means that the voice separation value of the signals relates more directly to the SNR differences between groups of microphones. Thus, VADs and other estimators can operate more effectively. If, however, groups of mics, either due to separation in space or other effects, acquire audio signals including very different noise components, and as a result there is no fixed compensation that can be pre-determined and applied (such as the correction factor discussed above), and noise matching is therefore not achieved consistently, then prediction of noise, VAD determinations and speech estimation may be degraded.

An embodiment herein aims to maintain the effectiveness (or accuracy) of a noise estimation process in different ambient environments. In particular, when using beamforming or a combination of microphones to produce each audio channel, the maintenance of voice separation and noise matching may not be trivial. In fact, beamforming by itself can sometimes create a frequency dependent scaling of components in an audio channel, which by its very nature has an effect both on voice separation and on noise matching. At the same time, beamforming is very useful in compensating for and adapting to different environments and device positions relative to the desired talker, etc. Here, the audio system aims to maintain sufficiently large voice separation and noise-matching simultaneously in a variety of cases. The audio system may improve voice separation and noise-matching even over cases where acceptable voice separation and noise-matching can be achieved by a non-adaptive system. In the audio system, each audio channel or "beam" can be defined as a linear combination of the raw signals available from multiple microphones. Such a group of microphones often constitutes a microphone array or a microphone cluster. For example, on a mobile phone, a cluster may be localized on one part of the phone, e.g. the bottom. A cluster may include some microphones from the bottom and some microphones from the top.

An embodiment herein aims to address the problem of how to adaptively or dynamically, e.g., during in-the-field use of a mobile phone that can be in a changing ambient environment, analyze available microphone signals that generate a plurality of acoustic beams to determine an appropriate pair or group of beams, such that at least one pair shows both good voice separation and good noise matching. In one embodiment, one acoustic beam, often the one with larger SNR, is used to pick-up a desired local voice (referred to as a "voice beam") and the other beam, typically having lower SNR, is used to pick up undesired ambient noise (referred to as a "noise beam"). Together the voice and noise beams drive VAD decisions, and the prediction and estimation processes previously mentioned. In this regard, in one embodiment, three or more acoustic pickup beams may be produced by any suitable combination of the microphone signals such that the acoustic pickup beams are simultaneously available, and a pair of the beams may be selected from these three or more available beams as inputs to a two-channel noise suppression process or a VAD. The analysis of the microphone signals and the available beams may be based on a number of factors, including positions of the microphones, and location information such as: the location of the source of the local desired voice relative to the positions of the microphones, the location of the source(s) of the ambient noise(s) relative to the positions of the microphones, the direction of the audio signal including the local voice relative to the position of the microphones, and the direction of the noise signal including the ambient noise relative to the position of the microphones. In one embodiment, these factors are also analyzed in order to determine which microphones should be assigned to produce a beam to pick up ambient noise (referred to as a "noise beam") and to produce a beam to pick up a desired local voice (referred to as a "voice beam").

In order to improve the reliability or accuracy of noise-matching and voice separation (which is expected to further improve the accuracy of the noise estimate computed by the noise suppression process), the beams may also be coordinated and designed. The acoustic pickup beams may be coordinated and designed based on a variety of factors including locations of the microphones, local voice and (ambient) noises as discussed above. In some embodiments, coordination and design of the beams may also include shaping the beams, directing the beams and identifying or assigning a subset of the microphones used to produce the beam. In this regard, in one embodiment, it is expected that the local voice or primary talker is closer to a first subset of microphones than another subset of microphones, and the acoustic pick up beam defined by the signals available from the first subset of microphones is considered to be the "voice beam". In this embodiment, a second subset of microphones is assigned to produce a beam to pick up the ambient noise, and the acoustic pick up beam defined by the signals available from this subset of microphones is considered to be the "noise beam". In other embodiments, the audio system may use audio-based blind source separation and estimation, or a camera, to locate a primary talker and/or any noise sources in the environment and to correlate this information with audio signals in order to determine which microphones should be used to generate a voice beam and which microphones should be used to generate a noise beam.

In one embodiment, possible pairs of noise beams and voice beams that may be produced by the microphone signals are tested based on the positions of the microphones, the locations of the local voice and the ambient noise and the directions of the local voice and the ambient noise to determine which beam pairs maintain thresholds for voice-separation and noise-matching. For example, thresholds are defined to maintain sufficiently large voice separation and noise-matching and two or more acoustic pickup beams are selected for input to a noise suppressor based on satisfaction of the thresholds. To determine whether there is sufficient noise-matching between two acoustic pick up beams, in one embodiment, instantaneous and average ratios are obtained over a time interval between a strength of a noise component in one beam and a strength of a noise component in another beam. In this regard, a conventional noise estimator may be used to extract the respective noise components, so that the respective strengths of the noise components may be calculated. The strengths of the respective noise components may be computed as power spectra in the spectral or frequency domain. The instantaneous and average ratios of the strengths of the respective noise components on the two pickup beams are then compared to the thresholds for noise-matching and if the thresholds for noise-matching are met, these beams are determined as being acceptable for noise-matching. Furthermore, a computed statistical central tendency of the difference in instantaneous and average ratios between the two beams can also be considered. This characterized central difference, which can be considered a long-term average of the differences, can be used to compute the correction factor for noise-matching. In one embodiment, the correction factor may be applied to compensate for any gross or stable frequency differences between responses of the various beams, such that after compensation the spectral shapes of the responses improve in matching.

To determine whether there is sufficiently large voice separation between two acoustic pick up beams, in one embodiment, initial ratios are obtained between a strength of the noise beam and a strength of the voice beam. The strengths of the respective beams may be computed as power spectra in the spectral or frequency domain. These ratios are considered during intervals of time when it is determined by a VAD or other means that the desired local talker is active. In embodiments in which a correction factor for noise-matching is used, this factor is applied appropriately to the initial ratios to account for the effect the correction factor would have on initial ratios if the correction factor had been applied first. Then the instantaneous and average ratios of the corrected ratios are obtained and compared to thresholds for voice separation.

If a pair of a voice beam and a noise beam is determined to satisfy the thresholds for noise-matching and voice separation, these beams can be selected for input to a noise suppressor or a voice activity detector (VAD). The selected voice beam that is voice dominant is provided as a voice input signal to a multi-channel noise suppression process or VAD, and the noise beam that is noise dominant is provided as a noise input signal to a multi-channel noise suppression process or VAD. This should enable the noise suppression process to produce more accurate voice activity decisions and noise and voice estimates which in turn should lead to a less distorted, noise-suppressed, voice output signal produced by the noise suppression process. In other embodiments, more than two beams may be selected as input to the multi-channel noise suppressor or the VAD. Also, in embodiments in which multiples pairs of beams satisfy the thresholds for voice-separation and noise-matching, selection of the beams balances the individual measures of voice separation and noise matching in order to select an appropriate beam pair. Long-term trends of the individual measures of voice separation and noise matching may also be considered, as well as the past selection of beams. If no pair of beams is found to satisfy the thresholds for voice-separation and voice-matching, the audio system may default to a single-channel noise suppression process, for example using the beam with the best estimated SNR as the single input to such a single-channel suppression process.

In order to improve control over coordination and design of the acoustic pickup beams, the microphones may be considered collectively as a microphone array or cluster whose geometrical relationship may be fixed and "known". In these embodiments, in the case where there are two or more microphone clusters, and each cluster can produce a respective pick up beam, the microphone clusters are spatially separated, and a cluster may be defined as a two or more microphones whose relative distance to each other is smaller than a distance to one of the microphones of another cluster.

In one embodiment, the approach described above is used together with phase-based interference cancellers.

The above summary does not include an exhaustive list of all aspects of the present invention. It is contemplated that the invention includes all systems and methods that can be practiced from all suitable combinations of the various aspects summarized above, as well as those disclosed in the Detailed Description below and particularly pointed out in the claims filed with the application. Such combinations have particular advantages not specifically recited in the above summary.

BRIEF DESCRIPTION OF THE DRAWINGS

The embodiments herein are illustrated by way of example and not by way of limitation in the figures of the accompanying drawings in which like references indicate similar elements. It should be noted that references to "an" or "one" embodiment of the invention in this disclosure are not necessarily to the same embodiment, and they mean at least one. Also, in the interest of conciseness and reducing the total number of figures, a given figure may be used to illustrate the features of more than one embodiment of the invention, and not all elements in the figure may be required for a given embodiment.

DETAILED DESCRIPTION

Several embodiments of the invention with reference to the appended drawings are now explained. Whenever aspects are not explicitly defined, the scope of the invention is not limited only to the parts shown, which are meant merely for the purpose of illustration. Also, while numerous details are set forth, it is understood that some embodiments of the invention may be practiced without these details. In other instances, well-known circuits, structures, and techniques have not been shown in detail so as not to obscure the understanding of this description.

Figure 1:
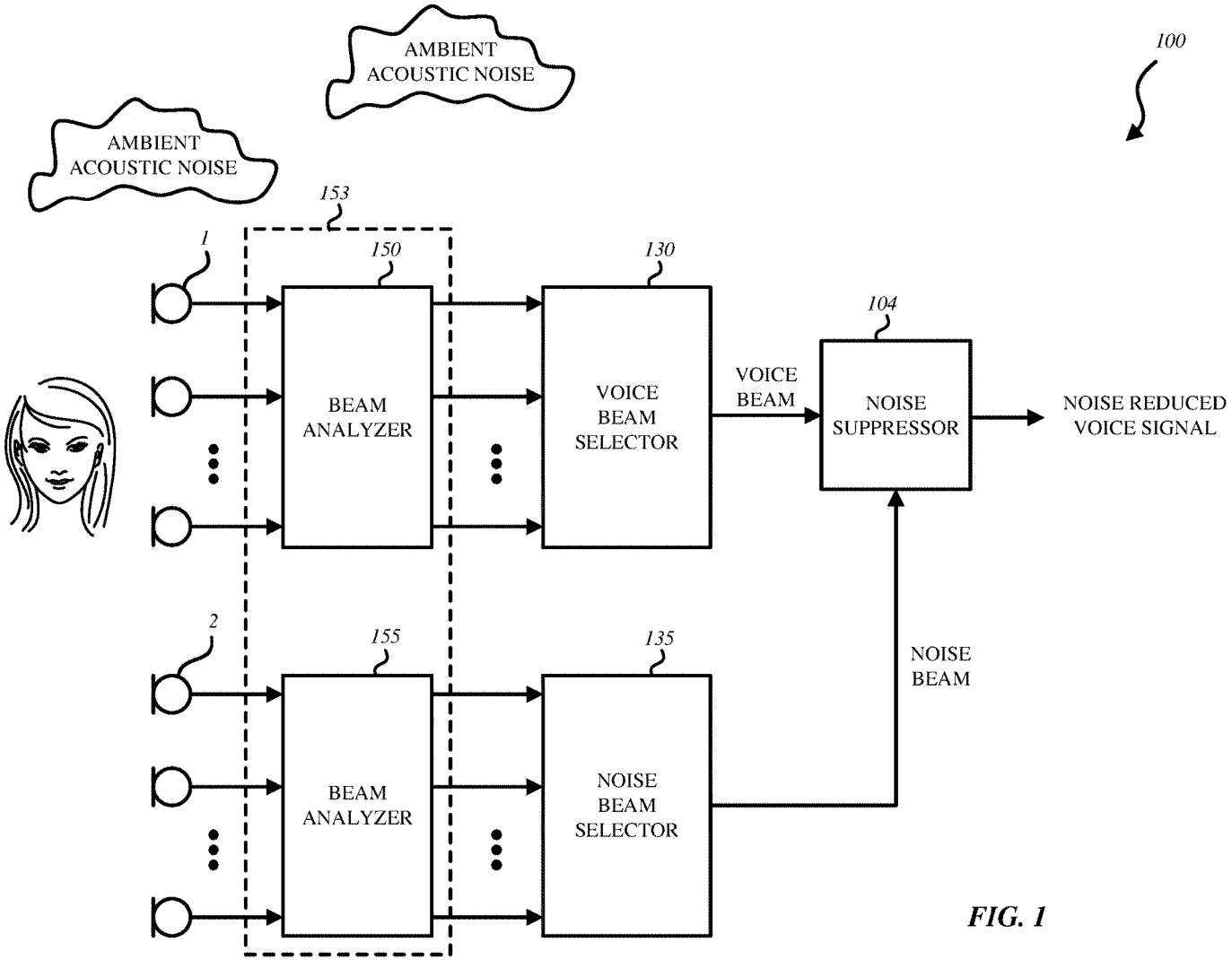
FIG. 1 illustrates a block diagram for explaining an audio system that produces a noise-reduced voice input signal according to one example embodiment.

The processes described below are performed by an audio system whose user as depicted in FIG. 1 is also referred to as the local voice or primary talker, who in most cases is positioned closer to one side of a housing of the audio system containing the microphones 1 and 2. The ambient environment of the local voice contains noise sources, which may include any undesired source of sound, and which in some scenarios are considered to be further away from the microphones than the desired talker. For example, such noises could be in the far field response of the microphones receiving the sound. Noise sources may also include a competing talker. The audio system may produce inputs of a multi-channel noise suppression process. In this regard, the example embodiment illustrated in FIG. 1 is used to describe both a process and an apparatus for producing the inputs of a two-channel noise suppression process illustrated in FIG. 3.

Figure 2:
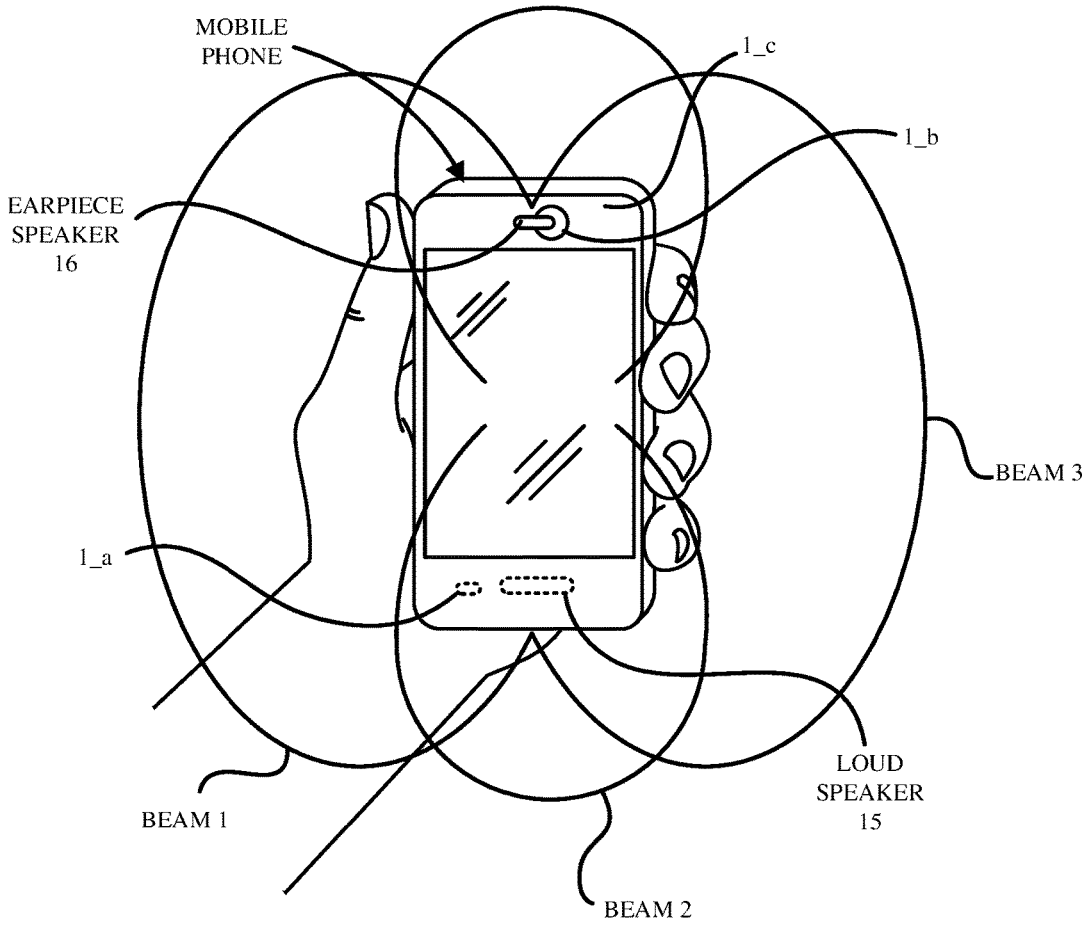
FIG. 2 illustrates a mobile phone hand set for explaining an example audio system, overlaid with some example beams.

A number of microphones 1 and 2 may be integrated within the housing of the audio system. An example is depicted in FIG. 2 as a mobile phone handset having three microphones, namely a bottom microphone 1_*a* and two top microphones 1_*b*, 1_*c*. The microphone 1_*c* may be referred to as a top reference microphone whose sound sensitive surface is open on the rear face of the handset, while the microphone 1_*b* has its sound sensitive surface open to the front and is located adjacent to an earpiece speaker 16. The handset also has a loudspeaker 15 located closer to the bottom microphone 1_*a* as shown. In the embodiment of FIG. 2, microphones 1_*a*, 1_*b* and 1_*c* have a fixed geometrical relationship to each other. Although FIG. 2 shows three microphones, in other embodiments, other numbers of microphones are possible, such as four or more.

In the embodiment of FIG. 2, microphones 1 and 2 may be one of the individual microphones 1_*a*, 1_*b*, 1_*c* or may be any combination of the individual microphones 1_*a*, 1_*b*, 1_*c*, such that microphones 1 is considered a first microphone array or cluster and microphones 2 is considered a second microphone array or cluster. In embodiments in which microphones 1 and 2 are clusters of microphones, the clusters are spatially separated such that the individual microphones included in one cluster are closer in distance to each other than the individual microphones included in another cluster. In these embodiments, a cluster may therefore be considered two or more microphones whose relative distance to each other is smaller than a distance to one of the microphones of another cluster.

It should be understood that other arrangements of microphones that may be viewed collectively as a microphone array or cluster whose geometrical relationship may be fixed and "known" at the time of manufacture are possible, e.g. arrangements of two or more microphones in the housing of a tablet computer, a laptop computer, or a desktop computer. In one embodiment, arrangements of any suitable number of microphones and microphones clusters in the housing of a tablet computer, a laptop computer, or a desktop computer are possible. In one embodiment, distributed arrangements of microphones and microphone clusters are possible. For example, the microphones and microphone clusters of the audio system may be arranged in separate housings of tablet computers, laptop computers, desktop computers, mobile phones or other audio systems. In one embodiment, the apparatuses and processes described herein may be implemented in audio systems for homes and vehicles, as well as speakers in consumer electronics devices.

Returning to FIG. 1, the signals from the microphones 1 and 2 are digitized, and made available simultaneously or parallel in time, to beam analyzer 153 which includes beam analyzers 150 and 155. Although the embodiment of FIG. 1 shows beam analyzers 153, 150 and 155 as separate components, in other embodiments these beam analyzers may be replaced by any number of beam analyzers including a single beam analyzer. The beam analyzers may therefore be combined or removed, and performed in parallel or in serial. The beam analyzers may be communicatively coupled so as to share information.

The microphones 1 and 2 including the individual sensitivities and directivities of the microphones included therein may be known and considered when configuring the beam analyzers 150 and 155, or defining each of the beams, such that the microphones 1 and 2 are each treated as a microphone array or cluster. Each of the beam analyzers 150 and 155 may be a digital processor that can utilize any suitable combination of the microphone signals in order to produce a number of acoustic pick up beams. Glancing at FIG. 2 again, three example beams are depicted there (e.g., beam 1, beam 2 . . . beam 3), which may be produced using a combination of at least two microphones, for example the bottom microphone 1_*a* and the top reference microphone 1_*c*. As another alternative, the beams may be computed as a combination (e.g. weighted sum) of two or more microphone signals from two or more of the microphones 1 and 2, respectively. More generally, the weighting could be implemented by a linear filter, where different filters run on the two microphones before the outputs are summed to produce a beam. The combination may be a simple weighted sum, where the scalar weightings are selected based on, for example, the relative difference of voice energy (energy of a voice component) on the microphone signals. This relative weight difference could be estimated by the difference between voice-separation values of the two or more beams relative to a common noise beam. For example, if the stronger beam or microphone has 20% more voice energy than the next strongest beam or microphone, then it may be weighted 20% more than that next strongest beam or microphone in a weighted combination of the two. In other embodiments, the audio system may determine that one beam, for example a noise beam, is fixed to be a single microphone signal, for example that of the top microphone 1_*c* (see FIG. 2).

Beams of other shapes and/or using other combinations of the microphones 1 and 2 (including ones that are not shown) are possible and may be suitable for a particular type of audio system, as a function of the shape of the housing, the geometrical relationship between the microphones 1 and 2, the sensitivities and directivities of the microphones 1 and 2, and the expected holding positions of the audio system by the user (e.g., handset mode vs. speaker phone mode). Design and production of the beams is discussed in more detail below with respect to the embodiments illustrated in FIGS. 4A and 4B.

Beam analyzers 150 and 155 receive as input the signals from microphones 1 and 2 and analyze the microphone signals to coordinate and design beams to be produced and tested. In one embodiment, beam analyzers 150 and 155 may each include a digital processor that can utilize any suitable combination of the microphone signals in order to produce a number of acoustic pick up beams, and pairs of the produced beams are analyzed for voice separation and noise matching. The design of the beams can include a selection of a pair of beams from a plurality of beam pair options. Such a design can include a more flexible definition of beams based on analysis of the device in use. One example would be to use estimations of a direction of arrival of both the desired speech source and other noise sources. Beam analyzers 150 and 155 may be communicatively coupled to each other in order to share information such as statistics on beams and microphones. The noise suppressor 104 can also pass information back to the beam analyzers. In this regard, noise suppressor 104 may be communicatively coupled to one or more of the beam analyzers in order to share information such as, for example, voice activity information.

Thus, beam analyzer 153 may generate a number of beams in order to analyze beam pairs, and may test candidate beam pairs in order to select a pair of beams having appropriate voice separation and appropriate noise matching. Beam analyzer 153 may share the generated beams with beam selectors 130 and 135. In addition, beam analyzer 153 may provide to the beam selectors 130 and 135 the selection information indicating the pair of beams to be selected from the plurality of candidate beams. In particular, voice beam selector 130 may receive the candidate beams and the selection information from beam analyzer 153, and may select the appropriate voice beam to forward as the voice dominant input to noise suppressor 104. Noise beam selector 135 may also receive the candidate beams and the selection information from beam analyzer 153, and may select the appropriate noise beam to forward as the noise dominant input to noise suppressor 104.

Generally, in the embodiment of FIG. 1, the analysis of beam pair options by beam analyzers 150 and 155 use comparisons of strengths of signals, for example comparisons of power spectrums of signals. The noise suppressor 104, expanded in more detail in FIG. 3, performs a suppression analysis and procedure using a "non-coherent" approach. In particular, the suppression analysis and process is based on estimation of strengths of signal components (e.g., spectral amplitude estimation or power spectrum estimation) of voice and noise components of a signal. The noise suppressor 104 uses such estimates to drive a scaling of components of the input noise beam in various spectral bands. In one embodiment, this scaling is between 0 and 1, where spectral bands with lower SNR (lower desired speech relative to undesired noise) see scale values closer to 0 than bands with higher SNR. This non-coherent approach makes it possible to control noise even in situations where relative phase estimates may be difficult to obtain, such as in ambient environments that are very dynamic or noisy.

As one example, suitable combinations of the signals from microphones 1 and 2 may generate a number of acoustic pick up beams. Beam analyzers 150 and 155 may each analyze the received microphone signals to determine which of the microphone signals will produce a beam that captures a desired source (such as a local voice) and an undesired source (such as ambient noise), respectively. The determination may be based on a variety of factors. For example, beam analyzers 150 and 155 may each determine a beam to be selected based on positions of the microphones 1 and 2, which may be known at the time of manufacture. In addition, the audio system may obtain location information about the source of the voice signal and/or the source of the noise signal relative to the positions of the microphones. The directions of a voice signal and/or a noise signal relative to the positions of the microphones may also be estimated. In this regard, in some embodiments, a camera may be used to locate a primary talker and/or any noise sources in an environment and to correlate this information with microphone signals, and the camera may provide this information to beam analyzers 150 and 155. In this way, beam analyzers 150 and 155 obtain the locations of the sources of the local voice and ambient noise, such that a "voice" beam may be selected and designed to pick up a desired voice and a "noise" beam may be selected and designed to pick up ambient noises. Also, in some embodiments, a blind source estimation technique may be used to analyze the microphone signals to determine locations and directions of a voice signal and a noise signal. For example, since the locations of the microphones are known, it is possible to perform blind source estimation to determine information on an angle at which the noise or voice source is located relative to the location of the microphones. Generally, beam analyzers 150 and 155 communicate to share information in order to select the voice and noise beams. In one embodiment, beam analyzers 150 and 155 compute how well a pair of beams match in estimating noise. Elements similar to those in the noise suppressor, such as Time to Frequency Calculators, Power Spectrum Calculators, Voice Activity Detectors, and Undesired Signal Power Spectrum Estimators, can also be included in the beam analyzers. In one embodiment, beam analyzers 150 and 155 compute the difference in signal strength between the beams when the desired speech is present. In both of these embodiments, such comparisons can be based on power spectrums of the two beams, which advantageously allows noise matching and voice separation to be considered both in time and frequency. In another embodiment the average difference in level between beams is determined when doing comparisons on noise matching. This average difference in level, if it shows a stable tendency over time, e.g. it does not change beyond a certain level (e.g. set or predetermined threshold) over time, can be used to compensate for gross average differences which may be due to the beamforming itself. This compensation is accounted for in both noise-matching and voice-separation determinations.

Figure 4B:
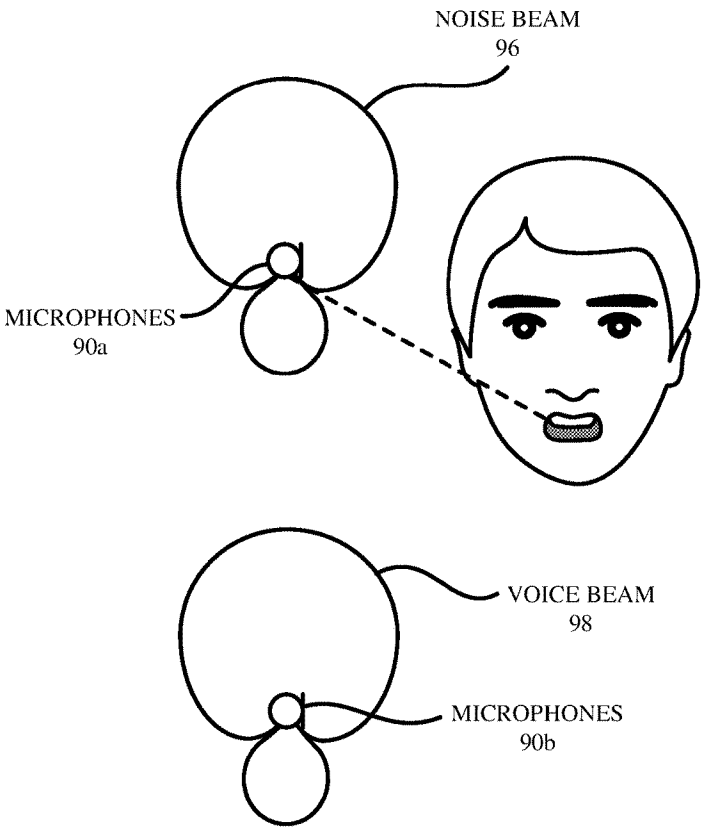
FIGS. 4A and 4B are representational views for explaining production and design of beams according to one example embodiment.
Figure 4A:
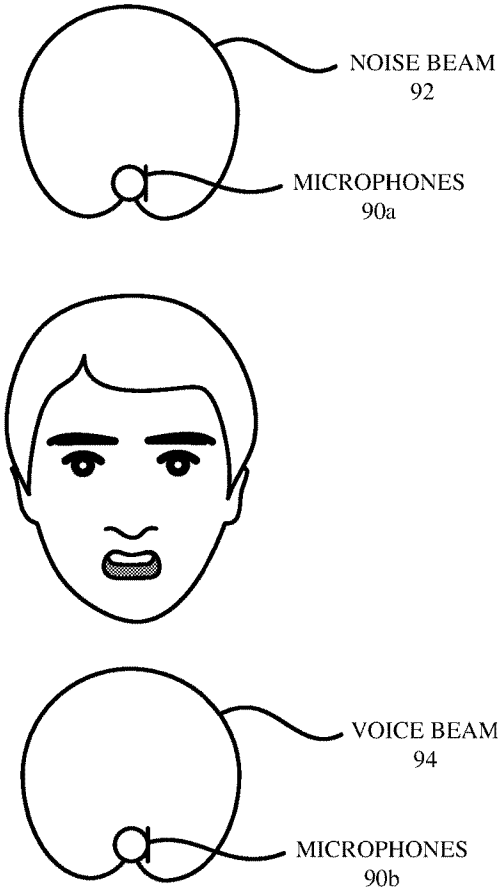

As mentioned above, in one embodiment, production of the beams by beam analyzers 150 and 155 includes design and coordination of a beam to pick up a desired local voice (referred to as a "voice beam") and a beam to pick up ambient noise (referred to as a "noise beam"), including shaping the beams and directing the beams. FIGS. 4A and 4B illustrate two possible cases for design and coordination of a voice beam and a noise beam according one example. FIG. 4A illustrates a case in which a primary talker is located between microphones 90*a* and 90*b*, and in which the shape of the noise beam 92 is the same as the shape of a voice beam 94. FIG. 4B illustrates a case in which the primary talker is located to one side of microphones 90*a* and 90*b*, and in which the shape of noise beam 96 and voice beam 98 are different. In the case of the primary talker being located to one side of microphones 90*a*, as in FIG. 4B, the beam analyzers may instruct the beamformers to produce beams, or select beams, having a shape similar to that in FIG. 4B. This helps the noise beam null the voice component picked up by the noise beam. The benefit may be measured in the increased voice separation this type of beam may have relative to the shape in FIG. 4A, if such a shape were used in with the same locations in FIG. 4B. In one example embodiment, the shape of the beams may be designed based on the expected positions in which the mobile phone handset will be held in one hand, during its use by the end user. Such holding positions include "normal" (against the ear), "up" (away from the ear with the error microphone 1_*b* facing the user), "out" (away from the ear with the reference microphone 1_*c* facing the user), and "down" (where the handset is being held essentially horizontally such that the reference microphone 1_*c* is facing downward and farther away from the user than the bottom microphone 1_*a*). The beams that have been defined for these various positions (e.g., one or more beams for each holding position) can be tested in the laboratory to verify that they result in a large enough voice separation value (while the phone is being used in the various holding positions).

In one embodiment, the positions of the microphones 1 and 2, the locations of the local voice and noise sources and the directions of the local voice and noise sources may be used together with the digitized microphone signals to determine which of microphone 1 and 2 should be assigned to produce the beam to pick up ambient noise (a "noise beam") and to produce the beam to pick up a desired local voice (a "voice beam"). Also, in one embodiment, assignment of the microphones clusters includes assigning a subset of the microphones used to produce the beam. For example, in the embodiment of FIG. 1, beam analyzer 150 determines that microphones 1 should be used to produce a voice beam, based on the location of the microphones 1 and 2 and the locations and directions of a local voice (not shown) and any noise sources (not shown). Accordingly, microphones 1 are assigned to produce voice beams. The remaining microphones 2 are assigned to produce noise beams. A particular example in which the audio system determines that the microphone cluster closer to the local voice may be assigned to produce a voice beam is discussed with respect to FIG. 6A to 6C. In this regard, in the embodiments of FIG. 6A to 6C, it is expected that the local voice or primary talker is closer to a first subset of microphones than another subset of microphones, and the acoustic pick up beam defined by the signals available from the first subset of microphones is considered to be the "voice beam". In this embodiment, the remaining subset of microphones is assigned to produce a beam to pick up the ambient noise, and the acoustic pick up beam defined by the signals available from this subset of microphones is considered to be the "noise beam". In other embodiments, the audio system may use blind source estimation or a camera to locate a primary talker and/or any noise sources in the environment and to correlate this information with audio signals. Accordingly, in embodiments in which there are more than two clusters of microphones, a different cluster may be assigned to produce voice beams than the noise beams.

In one embodiment, rather than performing beam forming, the beam analyzer forwards the digitized microphone signals from microphones 1 to a "voice" beamformer, and forwards the digitized microphone signals from microphones 2 to a "noise" beamformer. In this embodiment, the beam analyzer may be communicatively coupled to the beamformers in order to share information needed for beam forming, such as, for example, assignment information indicating a first subset of microphones to be used to generate a voice beam and a second subset of microphones to be used to generate a noise beam. The beamformers may each be a digital processor that can utilize any suitable combination of the microphone signals in order to produce a number of acoustic pick up beams. For example, voice beamformer may produce a voice beam using a combination of at least two of the microphones 1 to pick up the desired local voice, according to the instructions provided by the beam analyzer and noise beamformer may produce a noise beam using a combination of at least two of the microphones 2 to pick up the ambient noise, according to the instructions provided by the beam analyzer, such that criteria for voice-matching and noise-matching are maintained as described above. The beam analyzer may also provide as input to voice beamformer and noise beamformer the instructions for design and production of the beams, as described above in connection with FIGS. 4A and 4B. Based on these instructions, the beamformers may produce the appropriate beams by coordinating one or more of the following parameters as instructed by the beam analyzer: a shape of the voice beam, a shape of the noise beam, a general direction of the voice beam, a general direction of the noise beam, which microphone cluster 1 or 2 will be assigned to produce the voice beam, and which microphone cluster 1 or 2 will be assigned to produce the noise beam.

Returning to the embodiment of FIG. 1, beam analyzers 150 and 155, sharing information and doing joint computation, test possible pairs of noise beams and voice beams that can be produced by the microphone signals based on the positions of the microphones 1 and 2, the locations of the local voice and noise sources and the directions of the local voice and noise sources to determine which beam pairs maintain thresholds for voice-separation and noise-matching. Beam analyzers 150 and 155 may also select the beam pair that is most appropriate for a given situation based on characteristics of voice-separation and noise-matching between the beams.

In one embodiment, beam analyzers 150 and 155 obtain two main states of the audio system, one associated with an active state of the local voice and another associated with an inactive state of the local voice. For example, during in-the-field use of a mobile phone, the system may obtain a first state associated with the local voice (or near end desired source) being active and a second state associated with the local voice being inactive. In one embodiment, the noise suppressor 104 itself supplies the system with information regarding these two main states. For example, a VAD may be used to determine whether audio frames are in the active state of the local voice (e.g., when the VAD outputs a decision indicating speech, VAD=1) and the inactive state of the local voice (e.g., when the VAD outputs a decision indicating non-speech, VAD=0). In other embodiments, state information may be determined based on differences between strengths of beams or other statistics regarding the audio system. Voice activity decisions can also be made in a soft way, e.g. as a probability of local voice being present in which case there is a value from 0 to 1, or in different frequency subbands.

For audio frames (of a pair of beam signals) that are found to be in the "inactive" state, strengths from the pairs of beams are compared by beam analyzers 150 and 155 in order to determine whether there is sufficient noise-matching between the beams. With respect to noise-matching, improved noise matching can help to improve the accuracy of noise estimation process and/or VAD that may be part of a multi-channel or two-channel suppression process (further described below in connection with FIG. 3). Sometimes the effective comparison between each pair of acoustic pickup beams needs to take into consideration the fact that the response contained in a given beam to a given noise source may have a different frequency response relative to the response of another beam. In some cases, this difference may be relatively fixed or predictable, such as in cases where the difference is caused more by frequency dependent responses beams have in different directions than by beams picking up different sources. Thus, there may be situations in which the responses do not match due to this direction dependency and there may be unacceptable noise matching. These situations may be addressed by making a relatively fixed gross compensation, for example a frequency-dependent equalization between the two beams. This frequency-dependent equalization can be implemented by applying a linear filter to one or both beams, the linear filter being estimated over many audio frames. With such compensation the beams may have acceptable noise matching. More details are discussed below. It is desirable, when comparing the effectiveness of one beam to another (using the scheme described in FIG. 1) to compensate for any predictable or gross frequency variation between the response of a beam and that of another beam (to the same noise source, e.g. a far-field noise source). In some embodiments, a correction factor may be determined and applied to compensate for any frequency variation between responses of the various beams, such that the spectral shapes of the responses "match". The noise source may also be a transient source, including a competing talker, and thus the compensation may change depending on whether that noise source dominates the audio signal or is active.

In comparing strengths of beams to determine whether there is sufficient noise-matching between two beams, weights used for filtering one beam to match another may be estimated using a gradient descent technique such as a least mean square algorithm. The weights may also be applied directly to power spectrums of the beams with a weight for each power spectral bin. A given weight could be, for example, the average ratio between the energy in a given bin when comparing the two power spectrums of the pair of beams. In other embodiments, stability of such a frequency dependent scaling may be considered by beam analyzers 150 and 155. As one example, instantaneous and average ratios may be obtained over a time interval (e.g., a digital audio time frame) between a strength of a noise component (e.g. power spectrum bin) in one beam and a strength of a noise component in another beam (e.g. the same power spectrum bin), and the stability of the ratios over time may be considered to determine whether there is sufficient noise-matching. If a ratio is not stable over time, it may be determined that the relatively fixed gross compensation discussed above, does not apply. If a ratio is stable over time, it may be determined that the relatively fixed gross compensation does apply and may be used in equalizing the beams before determining noise matching. In some embodiments, a noise estimator may first be used to process the noise beam (the noise dominant input) and the voice beam (the voice dominant input) to compute the respective noise components, and the respective strengths of these noise components are used to determine instantaneous and average ratios over the time interval. The instantaneous ratios may be computed directly in the discrete time domain on a frame by frame basis. Alternatively, the instantaneous ratios may be computed in the discrete time domain at different points in time in each audio frame. In other embodiments, the strengths of the voice and noise beams are computed as power spectra in the spectral or frequency domain, or they may be computed as energy spectra. This may be based on having first transformed the primary and secondary sound pick up channels on a frame by frame basis into the frequency domain (also referred to as spectral domain.)

In one embodiment, if the frequency dependent scaling estimation between two beams is very dynamic in strength and spectral shape, it is possible that the two beams are not picking up similar noise sources (i.e., not "matching"). In such a situation the two beams may not be appropriate for multi-channel noise suppression. On the other hand, if the frequency dependent scaling estimation between two beams is stable with respect to strength and spectral shape, it is possible that the two beams are picking up similar unintended noise sources (i.e., "matching") and are candidates for selection. In one example embodiment, thresholds may be set for variation in strength and spectral shape of the frequency dependent scaling estimation between the two beams, and the variations in strength and spectral shape of the frequency dependent scaling estimation are compared to these thresholds in order to determine whether there is sufficient noise-matching between two beams. For instance, if values of the frequency dependent scaling estimation during the "inactive" periods are, for example: (5, 10, 1, 22, 11, 5, 100, 1, etc.) the beam analyzers may determine that beams do not meet the thresholds for noise-matching, since the variation between the values in the sequence is generally unstable. On the other hand, if values of the frequency dependent scaling estimation are, for example: (5, 4, 5, 4.5, 4.5, 4.5, etc.) or (11, 13, 11, 12, 11, 11, etc.) or (100, 110, 105, 120, 105, etc.), the beam analyzers may determine that the beams meet the thresholds for noise-matching, since the variations between the values in the sequence is generally fixed over time and is thus stable. In these examples, the thresholds for noise-matching may be set such that the variation between the values of the frequency dependent estimation should not be greater than a predetermined value. In these examples, the sequence of values of the frequency dependent scaling estimation may be values obtained from the microphone signals at different audio frames according to one embodiment. In other embodiments, the sequence of values are obtained at a different point in time in each audio frame.

In some embodiments, the frequency dependent scaling estimation discussed above is also used to determine the correction factor for the selected beams, in order to equalize ("EQ") the selected beams and spectrally shape them to compensate for variations in their far-field frequency responses. According to these embodiments, if the thresholds for noise-matching are met (i.e., if there is sufficient noise-matching between two beams), a computed statistical central tendency of the instantaneous and average ratios (which may be, for example, a mean of the instantaneous and average ratios) is set as a correction factor for noise-matching. It is therefore possible to have the strength of one beam at a similar level and general spectral shape as the strength of another beam, and to compensate for any frequency variation between responses of the various beams, such that the spectral shapes of the responses "match".

For audio frames that are found to be in an "active" state, a measure of difference between strengths from two beams is considered by beam analyzers 150 and 155 in order to determine whether there is sufficient voice-separation between the two beams. In this regard, generally, a voice-separation value may be a measure of the difference between the strength of a primary sound pick up beam, and the strength of a secondary sound pick up beam, where the local voice (primary talker's voice) is expected to be more strongly picked up by the primary beam than the secondary beam. In this case, the voice-dominated primary beam may be considered a "voice beam" and the secondary beam may be considered a "noise beam". In order to improve the reliability or accuracy of the voice separation value for a given beam (which is expected to further improve the accuracy of the noise estimate computed by the noise suppression process), the difference calculation may be performed after having spectrally shaped the noise beam, the voice beam, or both, using the correction factor so as to compensate for any frequency response variation between the far field responses exhibited by the voice beam and the noise beam.

According to one embodiment, for a pair of beams to have sufficient voice-separation, the strength of a desired voice beam may exceed the strength of an undesired noise beam by a threshold decibel (dB) amount. In other words, the voice-separation value for the two beams may be greater than or equal to the threshold amount. As one example, studies show that the voice separation value may be high when the talker's voice is more prominently reflected in the primary channel than in the secondary channel, e.g. by about 14 dB or higher. The separation value drops when the mobile phone handset is no longer being held in its optimal or normal position, for example dropping to about 10 dB and even further in a high ambient noise environment to no more than 5 dB.

According to some embodiments, to determine whether there is sufficient voice-separation between two beams, ratios are considered between a strength of a voice beam (a desired signal or an acoustic pickup beam dominated primarily by a primary talker's voice) and a strength of a noise beam (an undesired signal, or an acoustic pickup beam dominated primarily by noise). For example, initially, ratios are obtained between a strength of the noise beam and a strength of the voice beam. In embodiments in which the correction factor for noise matching has been determined, these ratios may be adjusted by applying the correction factor for noise-matching. In such embodiments, these adjusted ratios are compared to set thresholds for voice-separation in order to determine whether there is sufficient voice-separation between the two beams. In some embodiments, the adjusted ratios are used to obtain instantaneous and average ratios over a time interval (e.g, a digital audio time frame), and the instantaneous and average ratios are compared to the set thresholds to determine whether there is sufficient voice-separation. The instantaneous ratios may be computed directly in the discrete time domain on a frame by frame basis. Alternatively, the instantaneous ratios may be computed in the discrete time domain at different points in time in each audio frame. In other embodiments, the strengths of the voice and noise beams are computed as power spectra in the spectral or frequency domain. This may be based on having first transformed the primary and secondary sound pick up channels on a frame by frame basis into the frequency domain (also referred to as spectral domain.)

In some embodiments, frequency dependent scaling estimation is also considered by beam analyzers 150 and 155 during the "active" frames. In a case where a voice beam with a positive (>0 dB) signal-to-noise ratio (SNR) is assumed, there is often an expected rise in beam strength when a desired voice signal is present and relative levels or strengths of desired (voice) and undesired (noise) components may be estimated for each beam. This provides both signal-to-noise ratio measurements as well as measures of the voice level, and therefore indicates the amount of voice-separation. In the case where a positive SNR is assumed, a frequency dependent scaling estimation that is sufficiently stable between a pair of beams during "active" frames indicates strong voice components on both beams. In such a case, the pair of beams may not be an appropriate candidate for selection since they imply small voice separation. In particular, if one of the beams is not dominated by the desired voice, and the other is, as would be a prerequisite for having some voice separation, it is expected than when the desired voice is active the frequency-dependent energy on the beams would be different and constantly changing with that of the desired voice.

As discussed above, the ratios and values used to analyze noise-matching and voice-separation may be computed in the spectral domain, for each digital audio time frame. For example, there may be a voice separation vector and/or a correction factor vector defined, that has a number of values that are associated with a corresponding number of frequency bins. Alternatively, the voice separation value and/or the correction factor may be a statistical measure of the central tendency, e.g. average, of the difference (subtraction or ratio) between the primary and secondary input audio channels, as an aggregate of all audio frequency bins, or alternatively across a limited band in which the local voice is expected (e.g. 400 Hz to 1 kHz), or a limited number of frequency bins, of the spectral representation of each frame. A sequence of such vectors or values are continually computed, each being a function of a respective time frame of the digital audio. An audio signal can be digitized or sampled into frames that are each, for example, between 5-50 milliseconds long, where there may be some time overlap between consecutive frames.

In one embodiment, the strengths of the voice and noise beams (the primary and secondary channels, respectively, or the desired and undesired signals, respectively) are computed as power spectra in the spectral or frequency domain. This may be based on having first transformed the primary and secondary sound pick up channels on a frame by frame basis into the frequency domain (also referred to as spectral domain.) Alternatively, the strengths of the primary and secondary sound pick up channels may be computed directly in the discrete time domain, on a frame by frame basis. An example voice separation value may be an average log spectral difference measure as follows:

$$\text{Separation value} = \frac{1}{N}\sum_{i=1}^{N}(10\log PSpri(i) - 10\log PSsec(i))$$

Here, N is the number of frequency bins in the frequency domain representation of the digital audio frame, PSpri and PSsec are the power spectra of the primary and secondary channels, respectively, and i is the frequency index. This is an example where the strength of a signal is an average (over N frequency bins) power. Other ways of defining the voice separation value, based on a difference computation, are possible, where the term "difference" is understood to refer to not just a subtraction as shown in the example formula above of logarithmic values, but also a ratio calculation as well.

Also, with respect to the noise estimate produced by the noise estimator, each noise component extracted from the noise beam and the voice beam may be a respective noise estimate vector, where this vector has several spectral noise estimate components, each being a value associated with a different audio frequency bin. This is based on a frequency domain representation of the discrete time audio signal, within a given time interval or frame. A spectral component or value within a noise estimate vector may refer to magnitude, energy, or power, in a single frequency bin.

As described above, an embodiment herein aims to appropriately test and select two of several beams that are simultaneously available, for example during a phone call or during a meeting or recording session, as being the primary pickup channel (e.g., voice dominant input) and the secondary pickup channel (e.g., noise dominant input) of the two-channel noise suppressor 104. In other embodiments, more than two beams may be selected. In order to select the two or more beams, one or more of (1) the frequency dependent scaling estimation, (2) the stability of the frequency dependent scaling estimation and (3) SNR values may be considered by the beam analyzers during both "active" and "inactive" frames. For example, beam analyzers 150 and 155 may test one or more of these factors (1) to (3) for each pair of available beams that may be produced by microphone signals against the thresholds for noise-matching and voice-separation. In the example illustrated in FIG. 2, three example pairs are shown, namely beams 1 and 2, beams 1 and 3, beams 2 and 3. If one pair of beams is found to satisfy the thresholds for noise-matching and voice-separation, the beam pair is selected. In one embodiment, an equalization between the two beams of the pair may also be considered in making this determination. As one example, beam analyzers 150 and 155 may select a noise beam and a voice beam pair with the voice beam having a high SNR value for input to the noise suppressor 104.

In the case that multiple pairs of beams satisfy the thresholds, the criteria of voice-separation and voice-matching are balanced by the beam analyzers 150 and 155 in order to select an appropriate beam pair. For example, beam analyzers 150 and 155 may determine which beam of the pair is the voice beam and may select the beam pair having the highest voice separation for input to the two-channel noise suppressor (or a VAD). Referring to FIG. 2, the beam analyzers may find that the voice separation value that is associated with beam 2 and beam 3 is the largest among the three available pairs (e.g., beam 1 and beam 2, beam 1 and beam 3, beam 2 and beam 3), in this example, such that the beam analyzers forward or direct the use of beam 2 and beam 3 to the two-channel noise suppressor. If beam 1, 2 and 3 all match with respect to noise, then the pair with the highest voice separation is typically also the pair where the respective voice beam has the highest SNR (the highest energy when desired voice is active). As another example, in a situation where noise level is relatively high and the signal-to-noise ratio is very low, the beam analyzers may select a beam pair with better noise-matching, since in this case it may be more beneficial to improve noise estimation. On the other hand, depending on SNR it may at times be beneficial to select a beam pair with better voice-separation in order to obtain more accurate voice estimates.

It is therefore possible to choose two or more of several, simultaneously available acoustic pickup beams for input to a two-channel noise suppression process, thereby enabling the noise suppressor to produce a noise reduced voice input signal as illustrated in FIG. 1. In this regard, the selected beam that is expected to more strongly pick up the local voice (primary talker's voice) may be considered a "voice beam" and may be provided as the voice-dominant input to the noise suppression process. The remaining beam of the selected beam pair may be considered a "noise beam" and may be provided as the noise dominant input to the two-channel noise-suppressor 104. In other embodiments, the audio system may use blind source estimation or a camera to locate a primary talker and/or any noise sources in the environment, and this information is correlated with the beams in order to provide the beam that mostly picks up a local voice as the voice-dominant input and to provide the beam that mostly picks up noise as the noise-dominant input. Blind source separation may also define the beamforming vectors. It is also therefore possible for beam analyzers 150 and 155 to use the microphone clusters 1 and 2 to adaptively design voice beams and noise beams having appropriate beam directions and beam shapes, such that thresholds for voice-separation and noise-matching are met. This selection and application of beams to the inputs of the noise suppressor occurs dynamically and changes adaptively during use of the audio system, as a function of, for example, changing ambient noise sources or changing holding position (e.g., the way a mobile phone is being held by its end user.)

It is therefore possible to coordinate the choice, design and use of acoustic pickup beams to drive a noise suppression process, while maintaining good voice-separation and noise-matching. In addition, the noise suppression process may be simplified, since the spatially separated clusters of microphones 1 and 2 are used together with the beam analyzers 150 and 155 to produce beam pairs and beam selectors 130 and 135 to select an appropriate beam pair for input to the noise suppressor 104.

The beam analyzers 150 and 155 and the beam selectors 130 and 135 operate in parallel, where the term "parallel" here means that the sampling intervals or frames over which the audio signals are processed have to, for the most part, overlap in terms of absolute time. In addition, the beam analyzers 150 and 155 may be communicatively coupled to each other and to beam selectors 130 and 135 such that these components may exchange information and data. Indeed, to make comparisons on noise matching and voice separation the system compares pairs of beams created in 150 to those created in 155.

In the embodiment illustrated in FIG. 1, the selected beam pair is provided as input to the two-channel noise suppressor 104. An example noise suppressor having two channels is discussed in more detail with respect to FIG. 3. The voice beam and the noise beam are provided as input to the noise suppressor 104 which performs a suppression process.

Figure 3:
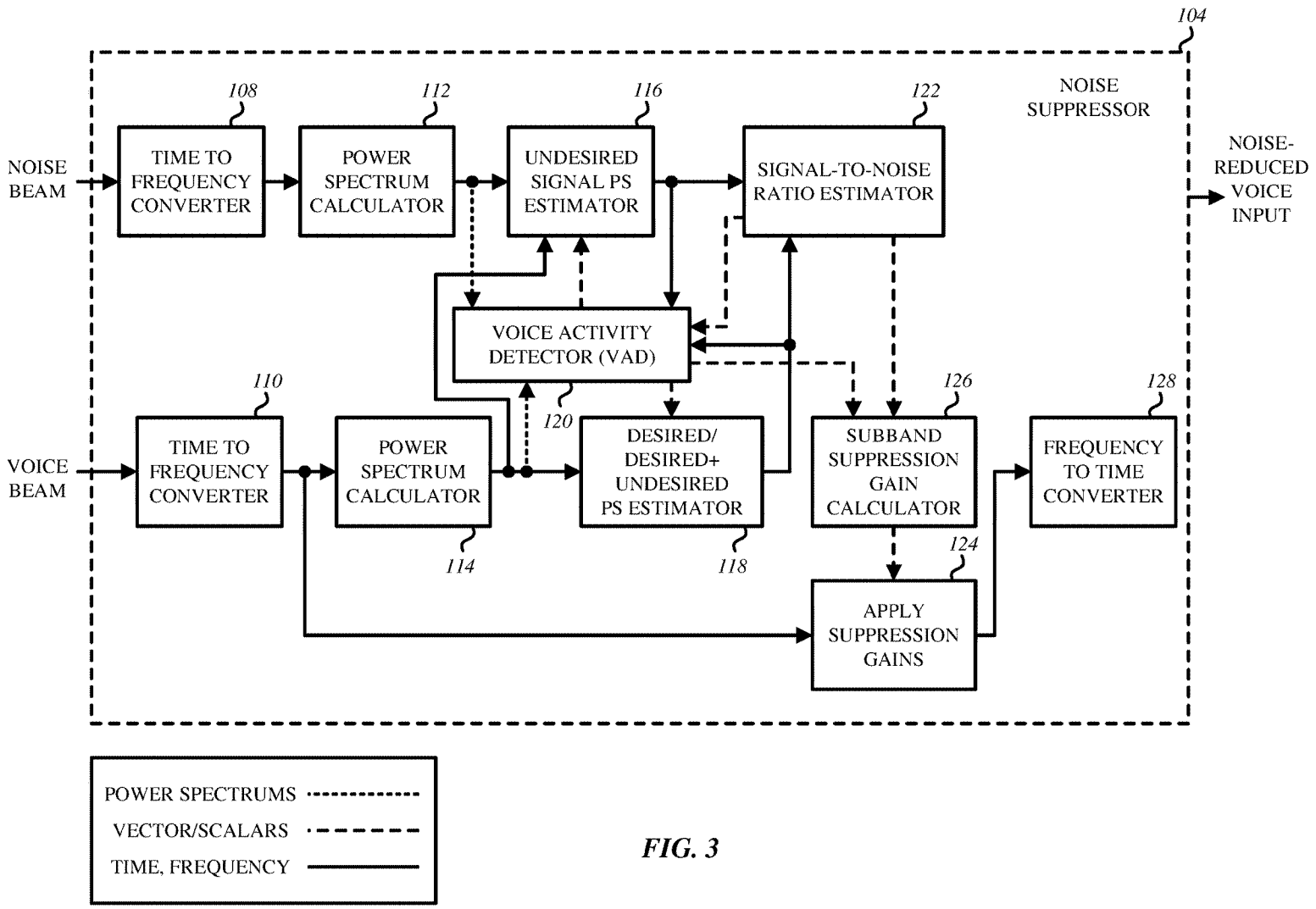
FIG. 3 illustrates a block diagram for explaining an example noise suppressor according to one example embodiment.

Referring to FIG. 3, the noise suppressor 104 includes time to frequency converters 108 and 110. The selected noise beam and voice beam are converted to a frequency domain representation by the time to frequency converters 108 and 110, respectively. These frequency domain representations together drive the estimation of strengths of the selected beams and a voice activity detector (VAD) 120. In the example of FIG. 3, power spectrums of the voice and noise beams are estimated by power spectrum calculators 112 and 114, respectively, using the frequency domain representations generated by the time to frequency converters 108 and 110. These power spectrums are then used as input to the power spectrum estimators 116 and 118 to drive estimation of an undesired noise signal and a desired voice signal. The power spectrums of the undesired and desired signals are provided as input to the signal-to-noise estimator 122 and may also be used as input to the VAD 120. A suppression gain calculator 126 receives as input signal-to-noise ratios calculated by signal-to-noise estimator 122 and information calculated by VAD 120 in order to calculate a set of suppression gains. The suppression gains are applied at 124 to the frequency domain representation generated by time to frequency convertor 110 and the suppressed output is converted back to the time domain by frequency to time convertor 128 in order to generate a noise-reduced voice output.

In the embodiment of FIG. 3, each of the components may be communicatively coupled to any of the other components in order to exchange information, such as vectors, scalars, time information, frequency information, and power spectrum information. For example, although not shown in FIG. 3, power spectrum estimators 116 and 118 may be communicatively coupled to each other.

It will be appreciated that the two-channel noise suppressor 104 illustrated in FIG. 3 is merely one example of a noise suppressor, and any suitable two-channel noise suppressor may be used in the context of the disclosure herein. In addition, it will be appreciated that the selected beams may be provided to a multi-channel noise suppressor or to a VAD, in other embodiments contemplated herein. With respect to a multi-channel noise suppressor, such a suppressor is often able to more accurately estimate strength components of noises, particularly non-stationary noises, and therefore is often able to more accurately suppress noise components while minimizing undesirable impact on a desired voice component. In other words, since the multi-channel noise suppressor uses multiple reference channels as input, it is typically able to estimate dynamic components of noise more accurately, even in the presence of a desired voice component.

With respect to a voice activity detector (VAD), a selected voice beam is provided to a voice dominant input of a voice activity detector (VAD), and a selected noise beam is provided to a noise dominant input of the VAD. In one embodiment, such a VAD is implemented by first computing $$\Delta X(k)=|X_1(k)|-|X_2(k)|$$

where $X_1(k)$ is the spectral domain component of the voice dominant input signal, and $X_2(k)$ is that of the noise dominant input signal. In other words, the term DeltaX(k) in the equation above is the difference in magnitude of spectral component k of the two input signals. Next, a binary VAD output decision (Speech or Non-speech) for spectral component k is produced as the result of a comparison between DeltaX(k) and a threshold: if DeltaX(k) is greater than the threshold, the decision for bin k is Speech, but if the DeltaX(k) is less than the threshold, the decision is Non-speech. The binary VAD output decision may be used by any available speech processing algorithms including for example automatic speech recognition engines.

For convenience, the embodiment of FIG. 1 illustrates selection of a beam pair including a voice beam and a noise beam for input to the noise suppressor (or VAD). In other embodiments, two or more beams may be selected as inputs. As one example, multiple noise beams may be used to pick up multiple noise sources. In this case, the noise suppressor may consider strengths of the various noise beams to derive suppression gains. As another example, multiple voice beams may be used to pickup the local voice or even to pickup more than one desired voice signal. More generally however, depending on the number of available beams, this embodiment may also encompass selecting more than two of the largest separation values, corresponding to more than two selected beams.

Also, in some embodiments, echo-coupling may be considered by the beam analyzers. Additionally, the beam analyzers may augment analysis of the beams with models representing a voice signal and a noise signal. For example, in addition to enhancing performance of the VAD, linear-predictive models of short and long-term correlations may be used to detect a primary talker's voice and to help differentiate between voice and noise signals on different beams. In these situations, various considerations may be used, for example, it may be considered that noise beams should not include strong voice components.

By virtue of the arrangement of FIG. 1, and particularly by selecting a noise beam in addition to a voice beam, the noise suppressor is better able to estimate strengths of noises, even in circumstances where the noises are non-stationary, transient or dynamic. In some situations, particularly if there is sufficient voice-separation between beams, it becomes possible to estimate strengths of undesired signals during desired-signal activity (during voice activity of a primary talker). In a case where the desired-to-undesired signal ratio on a beam dominated primarily by noise is extremely low (e.g., lower than that on the voice dominated beam by a good margin), a noise beam itself may provide a sufficiently accurate instantaneous estimate of the strength of the noise component.

It is therefore possible to coordinate the production, selection and use of acoustic pick up beams to drive a VAD, a noise estimation process and SNR calculations of a noise suppressor, and to set voice-separation and noise-matching criteria to ensure that these processes and calculations are effective in using two pick up beams. These criteria may include direct measures of how the power spectrum of one beam compares to the power spectrum of another beam. These criteria may also include measures on how the difference or ratio of the two power spectra change dynamically over time.

In the embodiment illustrated in FIG. 1, there may be situations in which no pair of beams is found by the beam analyzers to satisfy the criteria for voice-separation and voice-matching. In such situations, the audio system may default to a single-channel noise suppression process.

Figure 5:
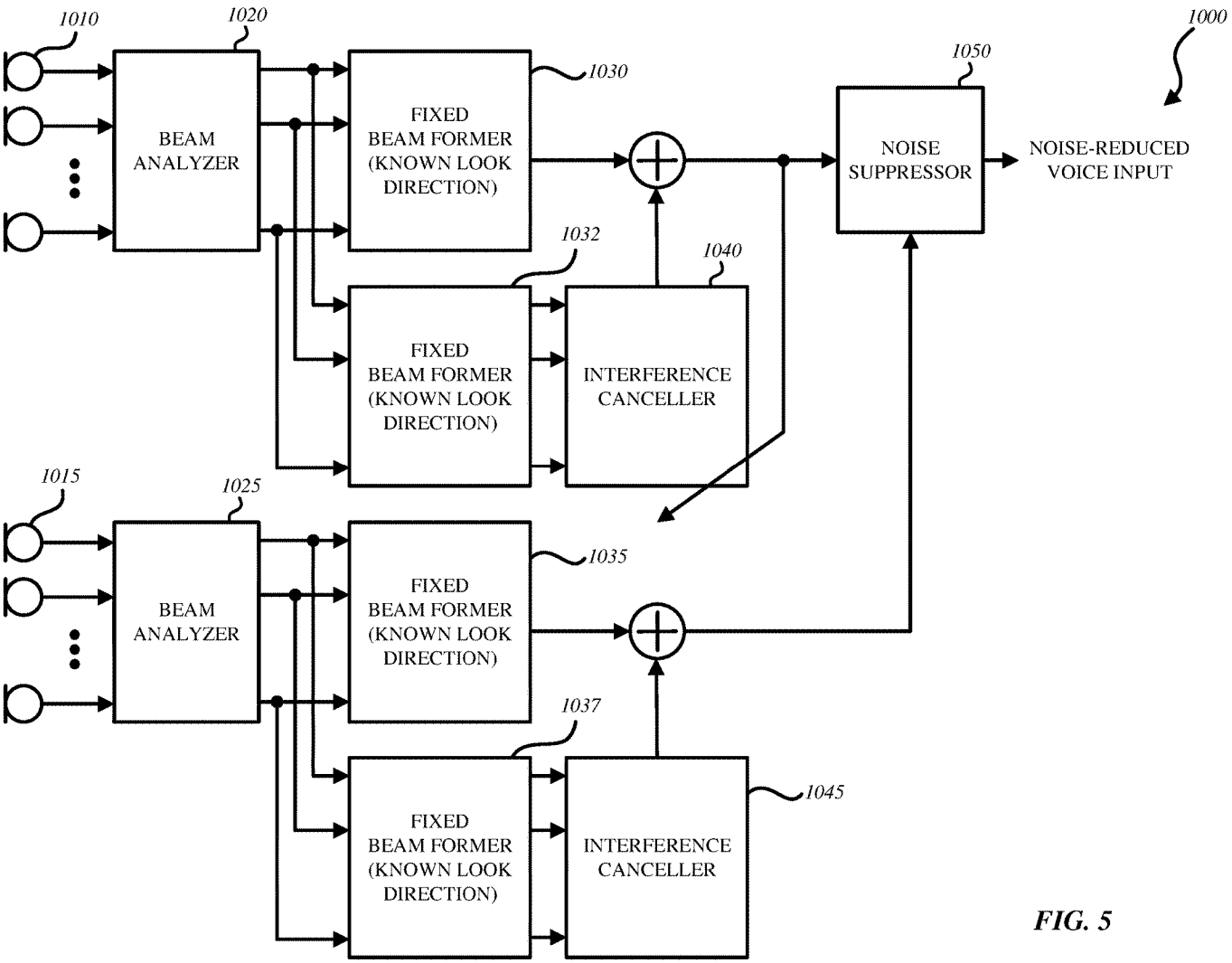
FIG. 5 illustrates a block diagram for explaining an audio system including an interference canceller according to one example embodiment.

FIG. 5 illustrates an embodiment in which the "non-coherent" approach discussed above in connection with FIG. 1 is combined with a "coherent" approach relying on phase information. In this embodiment, selected beams are used not only to drive a noise suppressor or a VAD, but also to drive a noise or interference cancellation process. Typically, coherent approaches cancel noise using phase information. One type of coherent approach is a "Generalized Sidelobe Canceller" (GSC) which directly uses beams for estimating, nulling or filtering out noise. In the embodiment of FIG. 5, interference cancellers (e.g., GSCs) 1040 and 1045 are used to process beams produced by fixed beam formers 1030, 1032, 1035 and 1037 based on instructions from beam analyzers 1020 and 1025 receiving digitized microphone signals from microphones 1010 and 1015. In this way, the beam formers may be able to remove noise components for which sufficiently accurate phase information can be estimated, leaving noise components for which sufficiently accurate phase information cannot be estimated. After processing by the interference cancellers, the beams are provided to the noise suppressor 1050, which is for example, the noise suppressor 104 of FIG. 3, and which helps to suppress noise components for which sufficiently accurate phase information cannot be estimated to produce a noise-reduced voice output.

The embodiment of FIG. 5 is particularly useful in situations in which some voice and/or noise components may be more accurately estimated with phase information, in which the phase information of other voice and/or noise components are not well characterized, and in which it is more advantageous to rely on power spectrum or energy measures which neglect phase information.

Figure 6A:
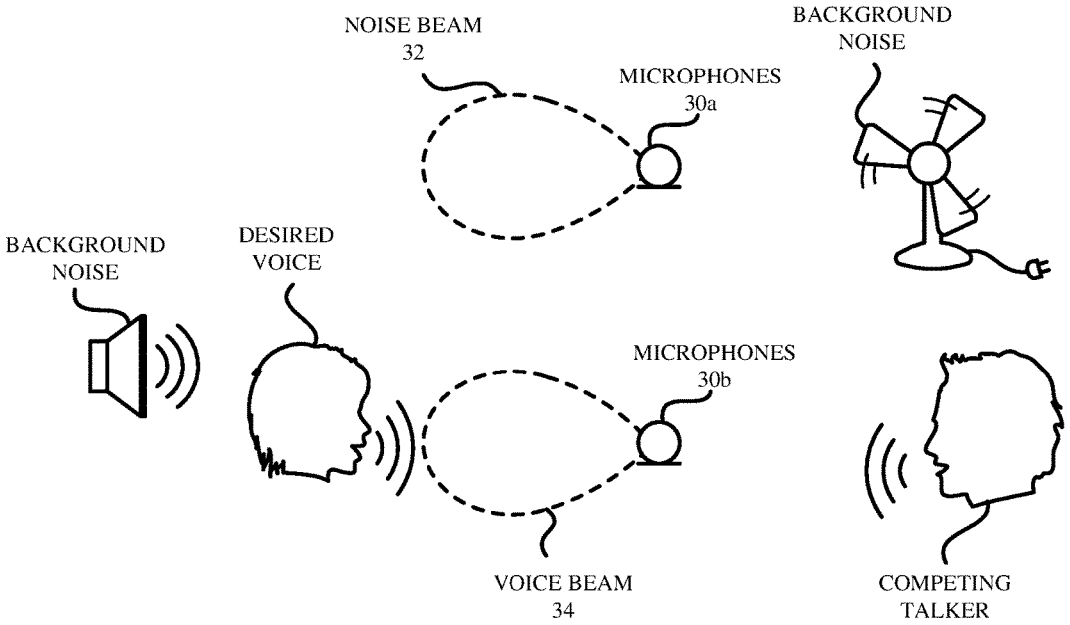
FIGS. 6A to 6C illustrates representational views for explaining an example embodiment in which two clusters of microphones are used to produce a voice beam and a noise beam.

FIG. 6A illustrates a representational view for explaining an example embodiment in which microphone arrays or clusters 30*a* and 30*b* are used to produce a voice beam 34 and a noise beam 32. Each of microphone clusters 30*a* and 30*b* may include a plurality of microphones and may produce a respective pick up beam. In addition, in the example of FIG. 6A, the locations of the microphone clusters 30*a* and 30*b* are known to the audio system. In this regard, the location of the cluster may be known at the time of manufacture or, alternatively, may be determined by the audio system. For example, arrangements of two microphone clusters in the housing of a tablet computer, a laptop computer, a desktop computer or a mobile phone are possible. In other embodiments, arrangements of more than two microphone clusters are possible. Also, distributed arrangements of the microphones are possible, such as microphones arranged in separate housings of tablet computers, laptop computers, desktop computers, mobile phones or other audio systems. Additionally, the apparatuses and processes described herein may be implemented for in-home use, consumer electronics devices and in-vehicle systems.

As illustrated in the example of FIG. 6A, the local voice or primary talker is closer to one cluster of microphones than the other (e.g., microphones 30*b*). For example, in the case of a mobile phone where the primary talker's mouth is closer to one end of the phone, it is expected that the source of the voice signal is closer to one microphone cluster. In other examples, there may be situations where microphones are deployed in a room setting, or where microphones are included in a laptop or computer having external accessories.

Figure 6B:
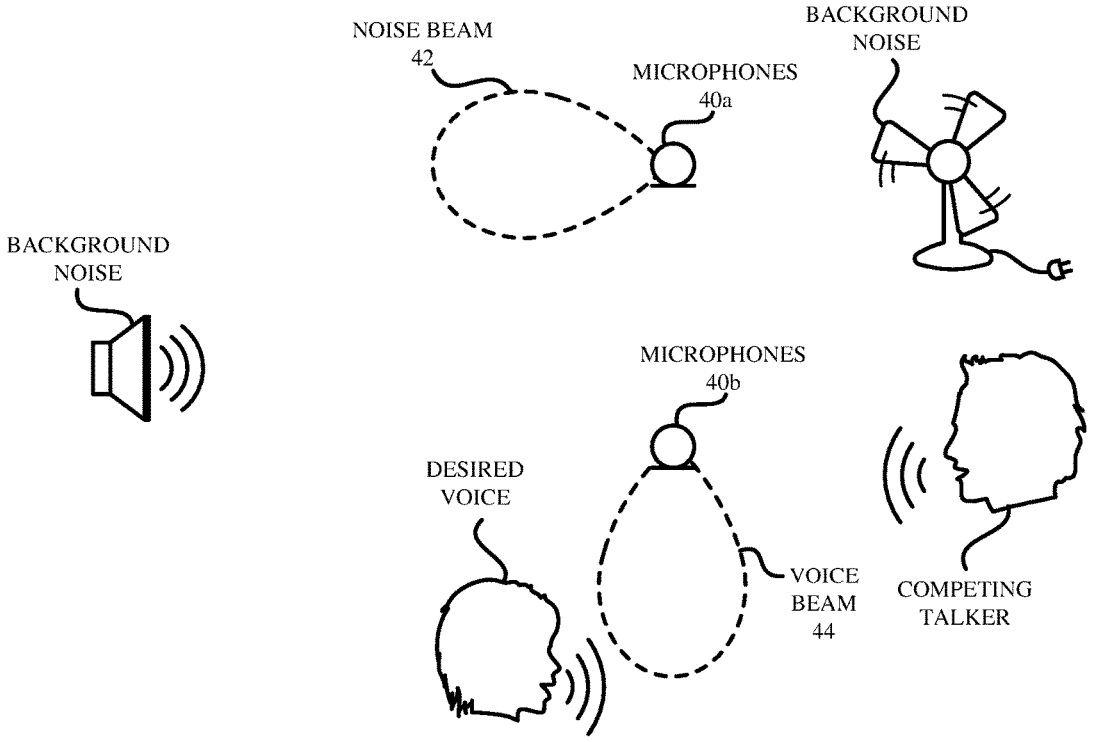
Figure 6C:
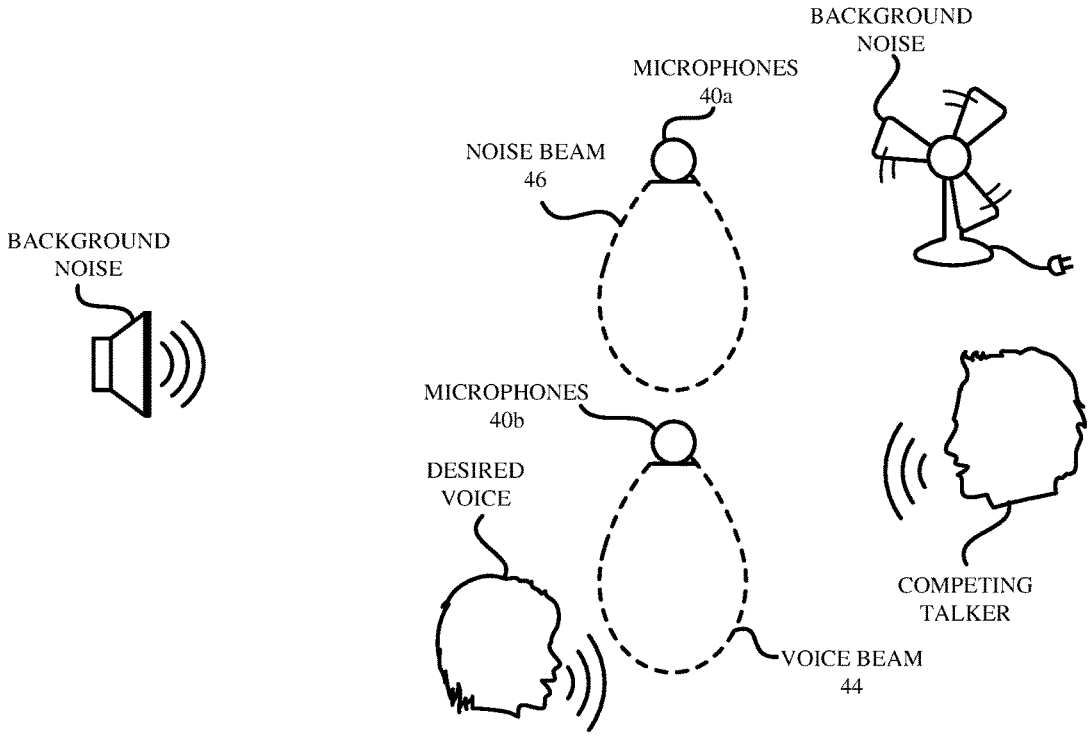

In the embodiment of FIG. 6A, the microphone clusters 30*a* and 30*b* are spatially separated, such that the microphones included in one cluster are closer in distance to each other than the microphones included in another cluster. A cluster may therefore be considered two or more microphones whose relative distance to each other is smaller than a distance to one of the microphones of another cluster. By virtue of the arrangement of the microphone clusters, and in particular the spatial separation of the clusters, propagation loss occurs between the microphone clusters and the local voice, thereby providing an amount of voice-separation. The voice separation value may further be improved by using the microphone clusters to produce a plurality of beams including, for example, a voice beam directed towards the local (primary talker's) voice together with an appropriate noise beam. In this regard, FIGS. 6B and 6C illustrate embodiments in which microphone clusters 40*a* and 40*b* may be used to generate additional candidate beam pairs, e.g. to address a situation where a local voice source is moving. Use of spatially separated microphone clusters is particularly advantageous in situations where a noise source is isotropic or non-directional.

Referring to FIG. 6B, if the source of a local voice or desired signal moves from a first position (such as the position shown in FIG. 6A) to a second position (such as the position shown in FIG. 6B), beam formers uses the microphone clusters 40*a* and 40*b* to generate an acoustic pickup beam 44 directed toward the new location of the local voice while the direction of the noise beam 42 is unchanged (from its position as shown in FIG. 6A.) In this arrangement, voice-separation is expected to be increased. However, it is also expected that the pair of beams will no longer have sufficient noise-matching. Therefore, according to the embodiment illustrated in FIG. 6C, beamformers use the microphone clusters 40*a* and 40*b* to generate not only a voice beam 44 directed toward the location of the local voice, but also a noise beam 46 directed toward the same general direction as the voice beam (i.e., the same general direction as the location of the local voice). In this way, production and use of the beams may be coordinated such that if design and direction of the voice beam changes, design and direction of the noise beam also changes accordingly in order to improve and achieve acceptable noise-matching between the beams. Thus, a beam pair having sufficient voice-separation and noise-matching may be generated by beamformers based on conditions during in-the-field use of a mobile phone that can be in a changing ambient environment.

In the embodiments illustrated by FIGS. 6A and 6B, the microphone cluster closer to the source of the local voice (e.g., microphone cluster 40*b*) may be assigned by the beam analyzers to generate a voice beam 44 and the remaining cluster (e.g., microphone cluster 40*a*) may be assigned to generate a noise beam (e.g., 42, 46). In other example embodiments, the audio system may assign any of the available clusters to generate a voice beam and assign the remaining cluster to generate a noise beam.

It is therefore possible to generate a voice beam and a noise beam that have sufficient voice-separation and noise-matching, such that unnecessary suppression of voice components and unmatched suppression of noise components may be avoided. In fact, in some situations where the microphones of one cluster have a similar fixed geometrical relationship to each other as the microphones of another cluster, and where the operating characteristics of one cluster are similar to the operating characteristics of another cluster, it may be possible for beamformers to generate the voice beam and the noise beam according to a similar design. In this way, the beam pair including a voice beam and a noise beam is provided as input to a noise suppressor or VAD, and a noise suppression process may be simplified. For example, both beams in FIG. 6C may be of a Cardioid design.

Figure 7:
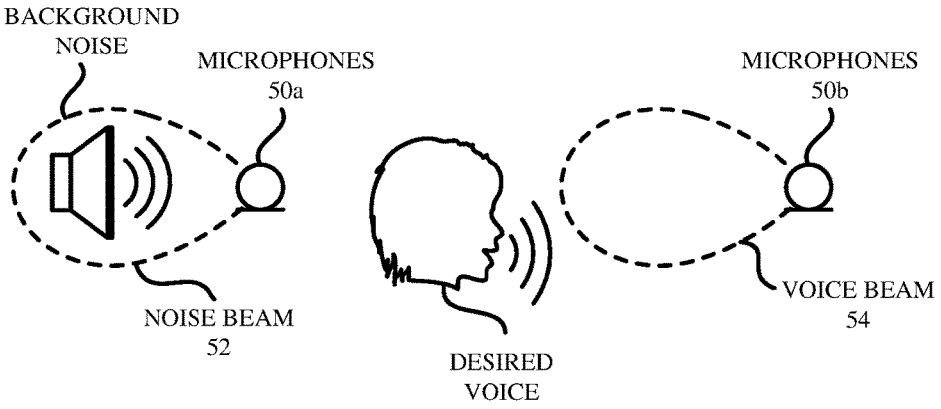
FIG. 7 is a representational view for explaining an example embodiment in which clusters of microphones are located on opposite sides of a primary talker.

Turning to FIG. 7, two microphone arrays or clusters 50*a* and 50*b* are illustrated on opposite sides of a local voice or primary talker according to an embodiment. One example approach for the audio system is to generate noise beam 52 and voice beam 54 in the same general direction, with the voice beam 54 directed toward the local voice and the noise beam 52 directed away from the local voice. In this way, it is advantageously possible to improve voice separation between the voice beam and the noise beam while also maintaining noise-matching.

Figure 8A:
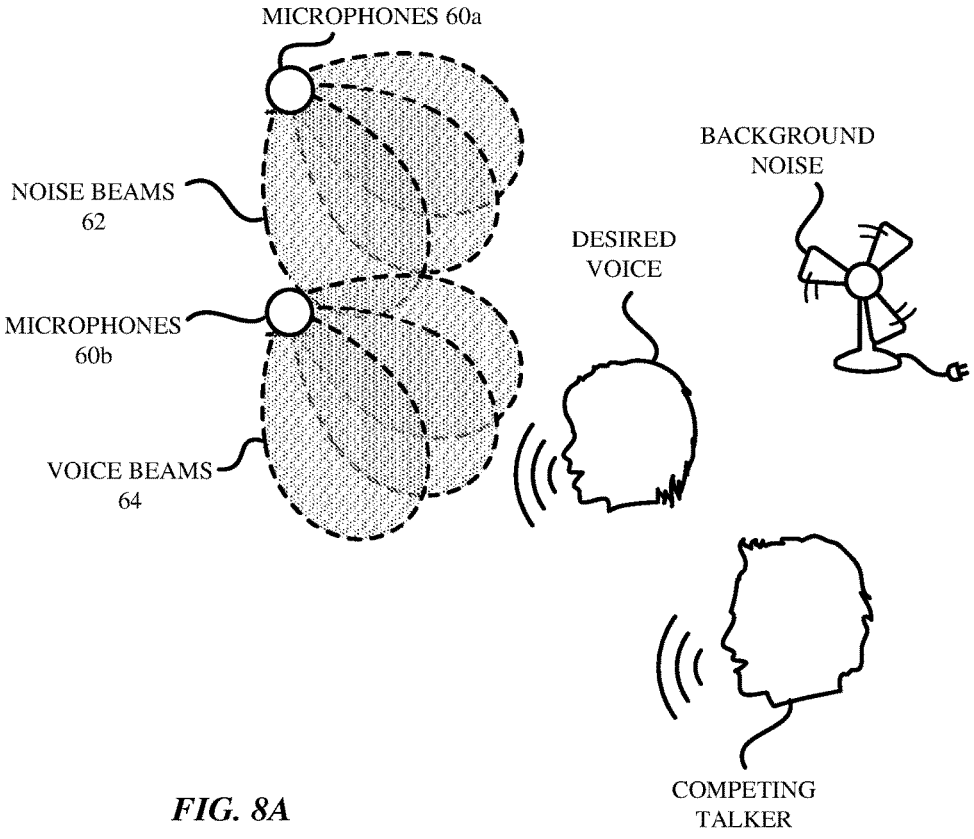
FIGS. 8A and 8B are representational views for explaining an example embodiment in which a beam pair is selected from a plurality of candidate beams.
Figure 8B:
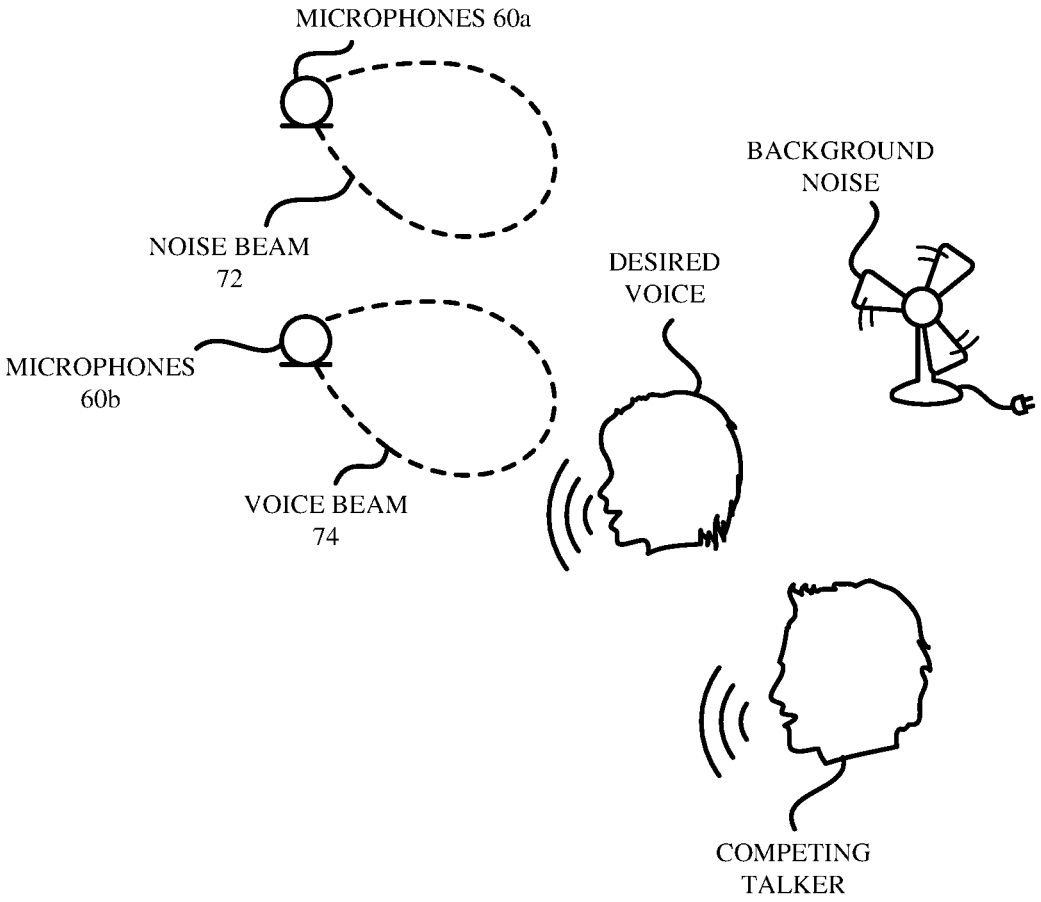

FIG. 8A illustrates an embodiment in which there are a plurality of beam candidates including a set of noise beams 62 and a set of voice beams 64 that can be produced by microphones 60*a* and 60*b*. Here, beam analyzers have assigned microphones 60*a* to produce candidate noise beams 62 and assigned microphones 60*b* to produce candidate noise beams 64 according to the process described herein. Beam analyzers compare the candidate beams in order to select two or more beams for input to a noise suppressor or VAD. In one embodiment, each of the candidate beams has been predetermined before the beam selection process begins, and these beams remain fixed during the process of adaptively changing the selection of the beams that are forwarded to the noise suppressor or the VAD. One example beam pair selection for the embodiment of FIG. 8A is illustrated in FIG. 8*b*. As shown in FIG. 8B, the beam analyzers select noise beam 72 and voice beam 74 from among candidate noise beams 62 and candidate voice beams 64 shown in FIG. 8A. In this example, noise beam 72 and voice beam 74 are generated by the beamformers such that they are directed away from the competing talker so that both beams pick up the background noise. Accordingly, this pair could be the beam pair having the highest voice-separation with acceptable noise-matching. In the embodiment of FIG. 8B, the audio system adaptively selects a beam pair from among the multiple beams generated by the set of beamformers based on conditions during in-the-field use of a mobile phone.

Figure 9:
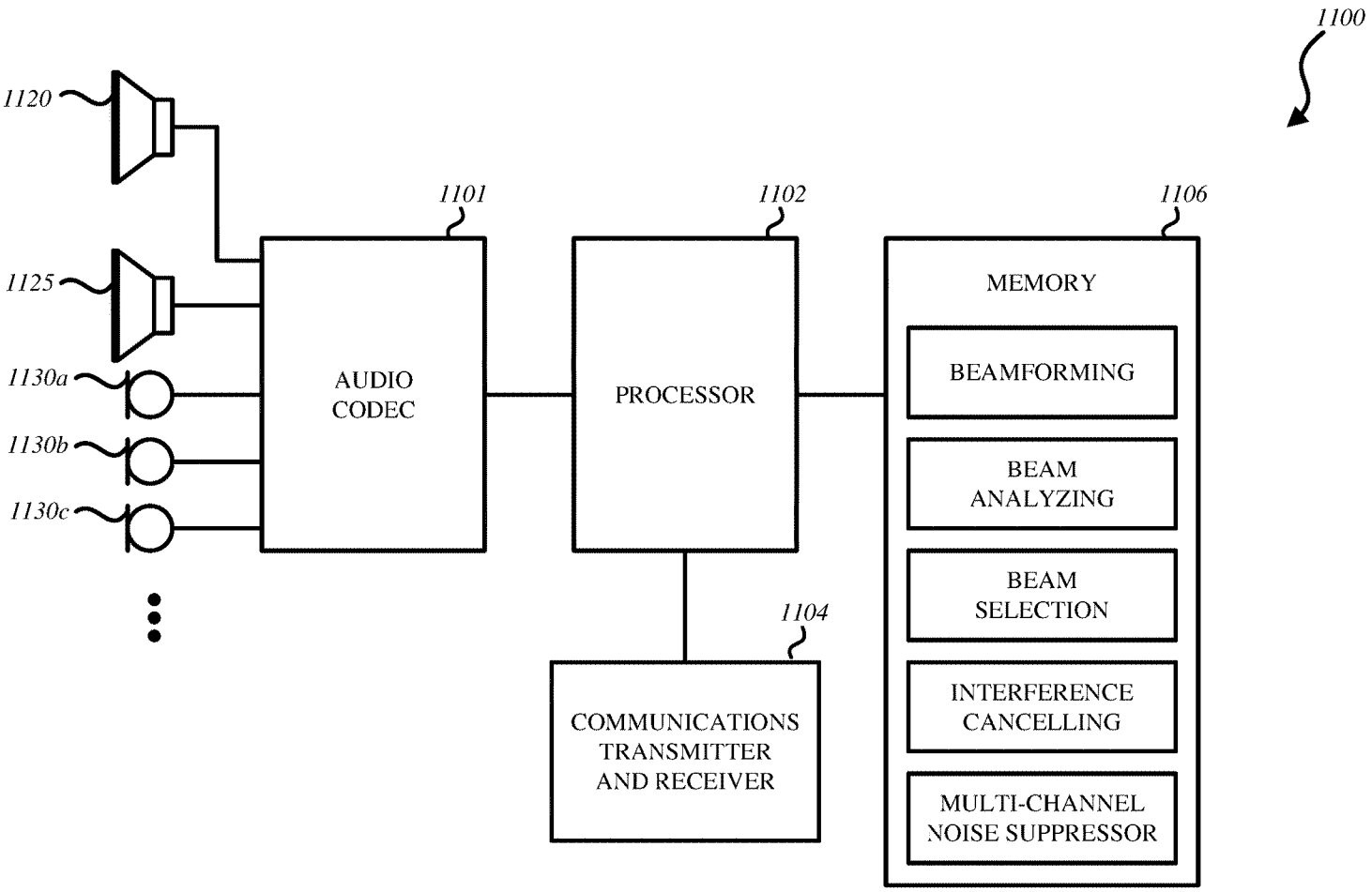
FIG. 9 illustrates an example implementation of the audio system that has a programmed processor.

FIG. 9 is an example implementation of the audio systems described above in connection with FIGS. 1 and 5, that has a programmed processor 1102. The components shown may be integrated within a housing such as that of a mobile phone (e.g., see FIG. 2.) These include a number microphones 1130 (1130*a*, 1130*b*, 1130*c*, . . . ) which may have a fixed geometrical relationship to each other and whose operating characteristics can be considered when configuring the processor 1102 to act as a beam former (e.g., as included in beam analyzers 153 and 155) when the processor 1102 accesses the microphone signals produced by the microphones 1130, respectively. The microphone signals may be provided to the processor 1102 and/or to a memory 1106 (e.g., solid state non-volatile memory) for storage, in digital, discrete time format, by an audio codec 1101. The processor 1102 may also provide the noise reduced voice input signal produced by the noise suppression process, to a communications transmitter and receiver 1104, e.g., as an uplink communications signal of an ongoing phone call.

The memory 1106 has stored therein instructions that when executed by the processor 1102 produce the acoustic pickup beams using the microphone signals, compute voice separation values and correction factors (as described above), select one of the acoustic pickup beams (as described above in connection with FIGS. 1 and 5), and apply the selected beams to inputs of a noise suppression process or VAD (as described above). The instructions that program the processor 1102 to perform all of the processes described above, or to implement the beam former(s), the beam analyzer(s) (e.g., beam analyzers 150, 153 and 155), the beam selectors (e.g., 130 and 135), interference cancellers (e.g., 1040, 1045), and noise suppressors (e.g., 104, 840, 1050), are all referenced in FIG. 9 as being stored in the memory 1106 (labeled by their descriptive names, respectively.) These instructions may alternatively be those that program the processor 1102 to perform the processes, or implement the components described above in connection with the embodiment of FIGS. 1 and 5. Note that some of these circuit components, and their associated digital signal processes, may be alternatively implemented by hardwired logic circuits (e.g., dedicated digital filter blocks, hardwired state machines.)

FIG. 9 is merely one example of a particular implementation and is merely to illustrate the types of components that may be present in the audio system. While the system 1100 is illustrated with various components of a data processing system, it is not intended to represent any particular architecture or manner of interconnecting the components; as such details are not germane to the embodiments herein. It will also be appreciated that network computers, handheld computers, mobile phones, servers, and/or other data processing systems which have fewer components or perhaps more components may also be used with the embodiments herein. Accordingly, the processes described herein are not limited to use with the hardware and software of FIG. 9.

Some portions of the preceding detailed descriptions have been presented in terms of algorithms and symbolic representations of operations on data bits within a computer memory. These algorithmic descriptions and representations are the ways used by those skilled in the data processing arts to most effectively convey the substance of their work to others skilled in the art. An algorithm is here, and generally, conceived to be a self-consistent sequence of operations leading to a desired result. The operations are those requiring physical manipulations of physical quantities. It should be borne in mind, however, that all of these and similar terms are to be associated with the appropriate physical quantities and are merely convenient labels applied to these quantities. Unless specifically stated otherwise as apparent from the above discussion, it is appreciated that throughout the description, discussions utilizing terms such as those set forth in the claims below, refer to the action and processes of an audio system, or similar electronic device, that manipulates and transforms data represented as physical (electronic) quantities within the system's registers and memories into other data similarly represented as physical quantities within the system memories or registers or other such information storage, transmission or display devices.

The processes and blocks described herein are not limited to the specific examples described and are not limited to the specific orders used as examples herein. Rather, any of the processing blocks may be re-ordered, combined or removed, performed in parallel or in serial, as necessary, to achieve the results set forth above. The processing blocks associated with implementing the audio system may be performed by one or more programmable processors executing one or more computer programs stored on a non-transitory computer readable storage medium to perform the functions of the system. All or part of the audio system may be implemented as, special purpose logic circuitry (e.g., an FPGA (field-programmable gate array) and/or an ASIC (application-specific integrated circuit)). All or part of the audio system may be implemented using electronic hardware circuitry that include electronic devices such as, for example, at least one of a processor, a memory, a programmable logic device or a logic gate. Further, processes can be implemented in any combination hardware devices and software components.

While certain embodiments have been described and shown in the accompanying drawings, it is to be understood that such embodiments are merely illustrative of and not restrictive on the broad invention, and the invention is not limited to the specific constructions and arrangements shown and described, since various other modifications may occur to those of ordinary skill in the art. The description is thus to be regarded as illustrative instead of limiting.

The invention claimed is:

1. A process for adaptively selecting two or more beams from among a plurality of acoustic pickup beams that are produced by a beamforming process using a plurality of microphone signals from a plurality of microphones, the process comprising: producing the plurality of acoustic pickup beams based on groups of the plurality of microphones, wherein the groups are determined based on an estimation of voice activity and an estimation of noise characteristics in the microphones signals; and selecting the two or more beams from among the plurality of acoustic pickup beams, including a voice beam and a noise beam, based on thresholds for voice-separation and thresholds for noise-matching, wherein during a period where a desired voice is deemed active, indicating presence of speech, difference between a strength of a component of the noise beam and a strength of a component of the voice beam are compared to a threshold for voice separation to determine whether there is sufficiently large voice separation between the noise beam and the voice beam, and during a period where the desired voice is deemed inactive, indicating non-speech, difference between a strength of a component of the noise beam and a strength of a component of the voice beam are compared to a threshold for noise-matching to determine whether there is sufficient noise matching between the noise beam and the voice beam, and wherein the voice beam is used to pick up a voice signal and the noise beam is used to provide information to estimate a noise signal; and wherein it is determined whether the two or more beams meet the threshold for noise-matching by a) obtaining ratios between the strength of a component of the noise beam in the noise beam and a strength of a component of the voice beam over a time interval, b) comparing the ratios to the threshold for noise-matching, and c) if the threshold for noise-matching is met, setting a correction factor for noise-matching; and it is determined whether the two or more beams meet the threshold for voice separation by calculating adjusted ratios by applying the correction factor to initial ratios between the strength of a component of the noise beam and the strength of a component of the voice beam.

2. The process of claim 1, wherein: the ratios are instantaneous and average ratios between a strength of a noise component in the noise beam and a strength of a noise component in the voice beam and the correction factor is a computed statistical central tendency of the instantaneous and average ratios.

3. The process of claim 2, wherein determining whether the two or more beams meet the thresholds threshold for voice-separation further includes:

comparing the adjusted ratios to the threshold for voice separation, wherein the adjusted ratios are instantaneous and average adjusted ratios.

4. The process of claim 1, wherein production of the plurality of acoustic pickup beams further comprises coordinating one or more of the following parameters: i) a shape of the voice beam, ii) a direction of the voice beam, iii) a shape of the noise beam, iv) a direction of the noise beam, v) a subset of microphones among the plurality of microphones used to generate the voice beam; and vi) a subset of microphones among the plurality of microphones used to generate the noise beam.

5. The Process of claim 1, wherein the plurality of microphones comprises a cluster, and wherein in a case where there are two or more clusters, the clusters are spatially separated.

6. The process of claim 5, wherein production of the plurality of acoustic pickup beams further comprises, in the case where there are two or more clusters, assigning a voice beam to a cluster and assigning a noise beam to a different cluster.

7. The process of claim 5, wherein the cluster is integrated into an enclosure of a mobile phone, tablet computer or laptop computer.

8. The process of claim 1, further comprising:

providing the voice beam included in the selected beams as a voice input signal to a multi-channel noise suppression process; and providing the noise beam included in the selected beams as a noise reference signal to the multi-channel noise suppression process.

9. The process of claim 1, further comprising:

providing the voice beam included in the selected beams as a voice input signal to a voice activity detector, and providing the noise beam included in the selected beams as a noise reference signal to the voice activity detector.

10. The process of claim 1, wherein directions of the voice signal and the noise signal are estimated and used in design and selection of the beams.

11. The process of claim 10, wherein the directions of the voice signal and the noise signal are estimated using a blind source estimation process to obtain directions of sources of the voice signal and the noise signal, respectively.

12. The process of claim 1, wherein the strength is a computed statistical central tendency of energy or power of a noise component in the noise beam or in the voice beam, over a predefined frequency band, in a given digital audio frame.

13. The process of claim 1, wherein the strength is a computed statistical central tendency of energy or power of the noise beam or the voice beam, over a predefined frequency band, in a given digital audio frame.

14. The process of claim 1, wherein the selected voice beam and the selected noise beam comprise a beam pair, and wherein if more than one beam pair satisfies the thresholds for voice separation and the thresholds for noise-matching, the beam pair including the voice beam having a highest signal-to-noise ratio is selected.

15. The process of claim 1, wherein the selected voice beam and the selected noise beam comprise a beam pair, and wherein if no beam pair satisfies the thresholds for voice separation and the thresholds for noise-matching, a single-channel noise suppression process is performed.

16. An audio system, comprising:

a housing having integrated therein a plurality of microphones having a fixed geometrical relationship to each other;

a processor to access a plurality of microphone signals produced by the plurality of microphones, respectively; and memory having stored therein instructions that when executed by the processor (a)

produce a plurality of acoustic pickup beams based on groups of the plurality of microphones, wherein the groups are determined based on an estimation of voice activity, and an estimation of noise characteristics in the microphone signals, and (b) select two or more beams, including a voice beam and a noise beam, from among the plurality of acoustic pickup beams based on thresholds for voice separation and thresholds for noise-matching, wherein selecting the voice beam and the noise beam, comprises, during a period where a desired voice is deemed active, indicating a presence of speech, difference between a strength of a component of the noise beam and a strength of a component of the voice beam are compared to a threshold for voice separation to determine whether there is sufficiently large voice separation between the two or more beams, and during a period where the desired voice is deemed inactive, indicating non-speech, difference between a strength of a component of the noise beam and a strength of a component of the voice beam are compared to a threshold for noise-matching to determine whether there is sufficient noise matching between the two or more beams, and wherein the voice beam is selected and used to pick up a voice signal and the noise beam is selected and used to provide information to estimate a noise signal, and wherein it is determined whether the two or more beams meet the threshold for noise-matching by a) obtaining ratios between the strength of a component of the noise beam in the noise beam and a strength of a component of the voice beam over a time interval, b) comparing the ratios to the threshold for noise-matching, and c) if the threshold for noise-matching is met, setting a correction factor for noise-matching; and it is determined whether the two or more beams meet the threshold for voice separation by calculating adjusted ratios by applying the correction factor to initial ratios between the strength of a component of the noise beam and the strength of a component of the voice beam.

17. The system of claim 16, wherein the ratios are instantaneous and average ratios between a strength of a noise component in the noise beam and a strength of a noise component in the voice beam over a time interval;

and the correction factor is a computed statistical central tendency of the instantaneous and average ratios.

18. The system of claim 17, wherein determining whether the two or more beams meet the thresholds for voice-separation further includes:

comparing the adjusted ratios to the thresholds for voice separation, wherein the adjusted ratios are instantaneous and average adjusted ratios.

19. The system of claim 16, wherein the memory has stored therein instructions that, when executed by the processor, produce the plurality of acoustic pickup beams by coordinating one or more of the following parameters: i) a shape of the voice beam, ii) a direction of the voice beam, iii) a shape of the noise beam, iv) a direction of the noise beam, v) a subset of microphones among the plurality of microphones used to generate the voice beam; and vi) a subset of microphones among the plurality of microphones used to generate the noise beam.

20. The system of claim 16, wherein the plurality of microphones comprises a cluster, and wherein in a case where there are two or more clusters, the clusters are spatially separated.

21. The system of claim 20, wherein the memory has stored therein instructions that, when executed by the processor, produce of the plurality of beams by, in the case where there are two or more clusters, assigning a voice beam to a cluster and assigning a noise beam to a different cluster.

22. The system of claim 16, wherein the memory has stored therein instructions that, when executed by the processor, provide the voice beam included in the selected beams as a voice input signal to a multi-channel noise suppression process and provide the noise beam included in the selected beams as a noise reference signal to the multi-channel noise suppression process.

23. The system of claim 16, wherein the memory has stored therein instructions that, when executed by the processor, provide the voice beam included in the selected beams as a voice input signal to a voice activity detector, and provide the noise beam included in the selected beams as a noise reference signal to the voice activity detector.

24. The system of claim 16, wherein directions of the voice signal and the noise signal are estimated and used in design and selection of the beams.

25. The system of claim 24, wherein the directions of the voice signal and the noise signal are estimated using a blind source estimation process to obtain directions of sources of the voice signal and the noise signal, respectively.

26. The system of claim 16, wherein the strength is a computed statistical central tendency of energy or power of a noise component in the noise beam or in the voice beam, over a predefined frequency band, in a given digital audio frame.

27. The system of claim 16, wherein the strength is a computed statistical central tendency of energy or power of the noise beam or the voice beam, over a predefined frequency band, in a given digital audio frame.

28. The system of claim 16, wherein the selected voice beam and the selected noise beam comprise a beam pair, and wherein if more than one beam pair satisfies the thresholds for voice separation and the thresholds for noise-matching, the beam pair including the voice beam having a highest signal-to-noise ratio is selected.

29. The system of claim 16, wherein the selected voice beam and the selected noise beam comprise a beam pair, and wherein if no beam pair satisfies the thresholds for voice separation and the thresholds for noise-matching, the processor executes a single-channel noise suppression process.

* * * * *